US008770302B2

(12) United States Patent
Spallini

(10) Patent No.: US 8,770,302 B2
(45) Date of Patent: Jul. 8, 2014

(54) PIPE ANCHORING AND EXPANDING UNIT FOR PRODUCING A SLIM WELL AND METHOD FOR PRODUCING A SLIM WELL USING THE SAME

(75) Inventor: Michele Spallini, Vasto (IT)

(73) Assignee: ENI S.p.A., Rome (IT)

( * ) Notice: Subject to any disclaimer, the term of this patent is extended or adjusted under 35 U.S.C. 154(b) by 427 days.

(21) Appl. No.: 12/747,316

(22) PCT Filed: Nov. 28, 2008

(86) PCT No.: PCT/EP2008/010164

§ 371 (c)(1),
(2), (4) Date: Aug. 31, 2010

(87) PCT Pub. No.: WO2009/074243

PCT Pub. Date: Jun. 18, 2009

(65) Prior Publication Data

US 2010/0314101 A1 Dec. 16, 2010

(30) Foreign Application Priority Data

Dec. 10, 2007 (IT) ..... MI2007A2308

(51) Int. Cl.
*E21B 23/01* (2006.01)

(52) U.S. Cl.
USPC ..... 166/380; 166/277; 166/207

(58) Field of Classification Search
USPC ..... 166/207, 277, 380
See application file for complete search history.

(56) References Cited

U.S. PATENT DOCUMENTS

| | | | | |
|---|---|---|---|---|
| 6,325,148 | B1 * | 12/2001 | Trahan et al. | 166/297 |
| 6,457,532 | B1 * | 10/2002 | Simpson | 166/380 |
| 7,117,941 | B1 | 10/2006 | Gano et al. | |
| 7,168,497 | B2 * | 1/2007 | Metcalfe et al. | 166/380 |
| 2002/0060079 | A1 * | 5/2002 | Metcalfe et al. | 166/387 |
| 2004/0040721 | A1 | 3/2004 | Maguire et al. | |
| 2004/0168796 | A1 | 9/2004 | Baugh et al. | |
| 2004/0216891 | A1 * | 11/2004 | Maguire | 166/380 |
| 2006/0000617 | A1 | 1/2006 | Harrall et al. | |
| 2006/0005973 | A1 | 1/2006 | Harrall et al. | |

FOREIGN PATENT DOCUMENTS

| | | |
|---|---|---|
| EP | 1 719 874 | 11/2006 |
| GB | 2 392 687 | 3/2004 |

* cited by examiner

*Primary Examiner* — Nicole Coy
(74) *Attorney, Agent, or Firm* — Oblon, Spivak, McClelland, Maier & Neustadt, L.L.P.

(57) ABSTRACT

An anchoring and expanding unit comprising an anchoring device (20, 20') and an expanding device (30, 30'), reciprocally removably constrained, the anchoring device (20, 20') being of the expandable type, wherein the expanding device (30, 30') includes a series of expanding means (33*a*, 33*b*) which can be extracted and blocked in at least two different operative positions, wherein the expanding means (33*a*, 33*b*) protrude radially from the expanding device (30, 30').

22 Claims, 19 Drawing Sheets

PIPE ANCHORING AND EXPANDING UNIT FOR PRODUCING A SLIM WELL AND METHOD FOR PRODUCING A SLIM WELL USING THE SAME

The present invention relates to an anchoring and expanding unit for pipes for producing slim wells and a method for producing a slim well for the extraction, for example, of water, oil or hydrocarbons in general, using the same.

In the oil industry, the term drilling means the series of operations aimed at producing a hole in the ground to extract hydrocarbons.

Among the numerous drilling techniques currently known, the most widely-used technique for reaching considerable depths is rotation drilling with direct circulation of fluids. In this technique, the penetration into the ground is due to a rotating bit at whose lower end a battery of drill pipes is screwed.

As the bit advances during drilling, it crushes the ground and produces cuttings which are lifted from the well bottom and brought to the surface by a drilling fluid.

This fluid is introduced into the surface, at the top of the drill pipes and circulates in their interior, subsequently exiting through fissures in the bit and reascending along the hollow space between the battery of drill pipes and the walls of the well.

After the drilling of a certain tract of the well, this is then covered through a series of columns or pipes and the hollow space which is created between said covering and the well walls is then cemented.

The covering columns offer various advantages, among which the supporting of the well walls and the reestablishment of the original tension. These covering columns, moreover, prevent contamination of the water tables with the drilling fluid, the migration of fluids between layers having different pressures and fluid losses.

The covering columns include a conductor pipe, a surface column, a series of intermediate columns and a production column.

These columns or pipes are inserted into the well inside each other and at increasing depths, in subsequent phases which alternate between drilling and casing running.

The traditional drilling of a well in several phases, for a series of planning and operative reasons, gives the well profiles the telescopic configuration shown in FIGS. 1*a* and 1*b*. FIGS. 1*a* and 1*b* respectively show a conductor pipe 1 which serves to sustain the surface formations, generally poorly consolidated, and to allow the circulation of mud. This is followed by the surface column 2, which has the purpose of protecting the water tables, sustaining the safety equipment and anchoring the subsequent columns.

The intermediate columns 3*a*-3*c* follow, which have the function of allowing the drilling of tracts with different mud densities, according to the fluid pressures in the formation pores.

Finally, the production column 4 reaches the mineralized formation and possibly, completely passes through it.

When possible, in order to reduce costs and have more space available, the intermediate columns 3*a*-3*c* can be anchored at the end of the preceding column by the overlapping of a limited tract, as shown in FIG. 1*b*. In this case, the intermediate columns 3*a*-3*c* are called "liners".

The number and diameter of the covering columns 1-4 of a well are selected on the basis of a series of parameters relating to the reservoir and well, such as, for example, the depth of the reservoir, the type of completion of the same, the production method which can be used, the well profile, the type of the same (explorative or productive), as well as on the basis of the drilling, piping, cementation, completion and maintenance costs and columns available.

As a general rule, there is the necessity of using reduced diameters in order to minimize the drilling times, obtain lower quantities of refluent fluids to be disposed of and reduce the cost of the columns and equipment.

The telescopic shape of the well profile which is obtained by means of the known techniques, however, does not allow a great reduction in the diameters to be drilled. These wells, in fact, start from the production column 4 whose diameter is such as to allow the passage of the completion equipment envisaged and the dimensions of the other columns are established, bearing in mind that the clearance between the same must be such as to allow their passage inside each other.

In some known ground drilling methods, expandable columns are used. These columns are made of a more ductile material which, by means of the mechanical action of an expanding device or expander which acts from the inside, such as, for example, an ogive, can be expanded beyond the elastic limit, thus obtaining a rigid structure having a larger diameter.

In these columns, when expanded inside another covering column 1-4 or in an open hole, the external hydraulic insulation is obtained by means of elastomeric seals or, preferably, through the cementation of the hollow space.

Furthermore, the connection of a column to the previous one is effected by means of an expandable anchoring device called expandable liner hanger. This device normally includes a sleeve having slips and elastomeric seals on the outside, to allow the anchoring to the previous column, also ensuring its hydraulic seal.

A known ground drilling method using expandable columns envisages, after drilling the phase of interest, the running of the expandable column and an anchoring and expanding unit comprising an expandable anchoring device and a conical expander through the drilling pipes. The expander used in this method is connected to the lower part of the expandable column. Once the column has been lowered to the bottom of the open hole, cementation takes place, for example by pumping mortar inside the drill pipes making it flow inside the annulus between the column and the open hole.

The column and anchoring device are expanded, before the solidification of the cement, so that, at the end of the cementation phase, a perfect anchoring is obtained in addition to a hydraulic seal.

Firstly, there is the expansion of the column, which takes place from the bottom upwards, pressurizing the area beneath the expander. An upward thrust is thus created, acting on the expander which, as it ascends, expands the column in the tract of interest to an equal diameter.

When the upper part is reached, hooking to the preceding column 2, 3*a*, 3*b* is effected by means of the expansion of the anchoring device, through the activation of the external seals.

Once the mortar has solidified, the casing shoe is milled and the drilling of the subsequent phase is restarted, with a smaller diameter, as the overlapping tract between the two columns 2, 3*a*, 3*b*, 3*c*, in correspondence with the anchoring device, does not allow the diameter of the upper column to be conferred to the lower column.

This operative expansion procedure from the bottom to the upper part offers the advantage of having a column thickness, at the end of the expansion, almost the same as the initial one, with positive effects on the mechanical resistance of the same. As the hooking to the upper column occurs at the end of the expansion phase, in fact, the material for contributing to the enlargement is supplied to the detriment of a shortening of the lower column, rather than through a reduction of its thickness.

This operative procedure, however, proves to be less safe, as, should problems arise, it is difficult to extract the expander from the expandable column, as it remains wedged. It is consequently not possible to react in short times.

Another currently known ground drilling method using expandable pipes envisages the running of the expandable columns through the drill pipes to which they are connected in their upper portion, in particular at the height of an anchoring device.

The expansion occurs through a three-roll expander, assembled on radial-stroke hydraulic pistons. Expansion first takes place from the lower to the upper part of the anchoring device, to constrain the lower column to the previous one.

During this first operation, the column of expandable pipes is temporarily constrained to the previous one through a third anchoring device. It is subsequently necessary to extract the battery of drill pipes and remove this third anchoring device, having such a diameter that it does not allow the expander to pass into the expandable tubes to effect the downward expansion of the expandable column.

The downward expansion mode through a roll expander offers the advantage of being able to set up the operative procedure more finely and consequently to obtain an optimal expansion result. Furthermore, the expansion of the column through rolls takes place more gently with respect to a fixed expander, with less damage to the material.

And again, by operating downwards, in the case of problems, it is possible to free the drill pipes in short times and solve the problem.

The two expansion phases of the anchoring means and of the column itself, on the contrary, can only be effected through the removal of the particular temporary anchoring device, thus causing relatively long operating times.

The operative methods of this system, moreover, imply the impossibility of hydraulically isolating the column through its cementation.

It is therefore possible to effect a hydraulic seal only by means of elastomeric external seals.

Finally, a ground drilling method is known which uses expandable columns envisaging a downward column expansion with a particular device that includes an expander assembled on a hydraulic piston and anchoring slips.

This device is firstly constrained to the previous column through pressurization from the inside of the drill pipes, with which it is lowered. In this way, the slips protrude and anchoring against the inner wall of the column takes place. Pressurization also causes the opening of the hydraulic piston, which pushes the expander downwards. When the piston has ended its stroke, the device must be depressurized, the slips released, and the whole battery lowered to expand a subsequent tract of the column.

The result is a discontinuous action, and the overall expansion times are extended.

An objective of the present invention is to overcome the above-mentioned drawbacks, in particular to conceive a column anchoring and expanding unit which allows a slim well, substantially mono-diameter, to be produced in short times.

Another objective of the present invention is to provide a pipe anchoring and expanding unit capable of guaranteeing a high safety level and at the same time allowing the isolation of the ground layers through cementation.

A further objective of the present invention is to provide a ground drilling method capable of producing a slim well, preferably mono-diameter, in short times.

Yet another objective of the present invention is to provide a drilling method which allows a high number of intermediate phases to be effected, substantially not being subject to a reduction of the well diameters.

An additional objective of the present invention is to provide a drilling method which is capable of producing a mono-diameter well having a high resistance.

This and other objectives, according to the present invention, are achieved by producing an anchoring and expanding unit for the production of a well as specified in claim 1, and a drilling method using the same.

Further characteristics of the unit and method are object of the dependent claims.

The characteristics and advantages of a unit and method according to the present invention will appear more evident from the following illustrative and non-limiting description referring to the schematic drawing enclosed herewith, in which:

FIGS. 1*a*-1*b* are a schematic representation of the wells produced by means of the anchoring and expanding unit and the drilling methods according to the present invention;

Figure 7:
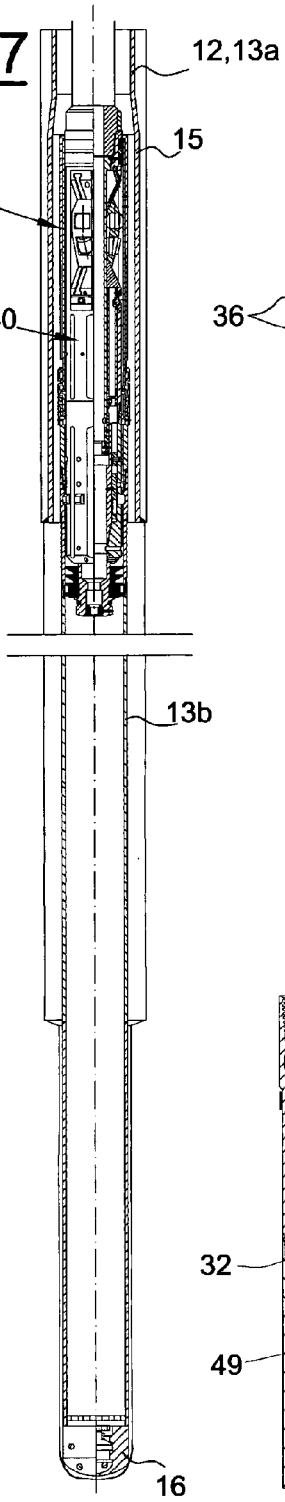
Figure 7A:
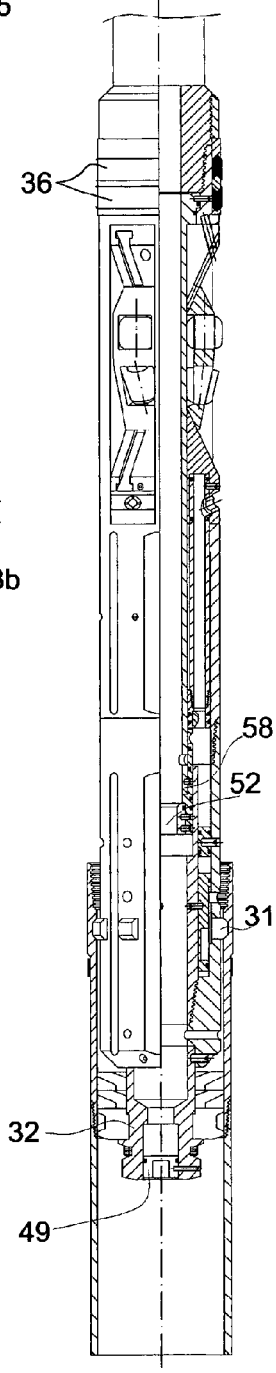
Figure 7B:
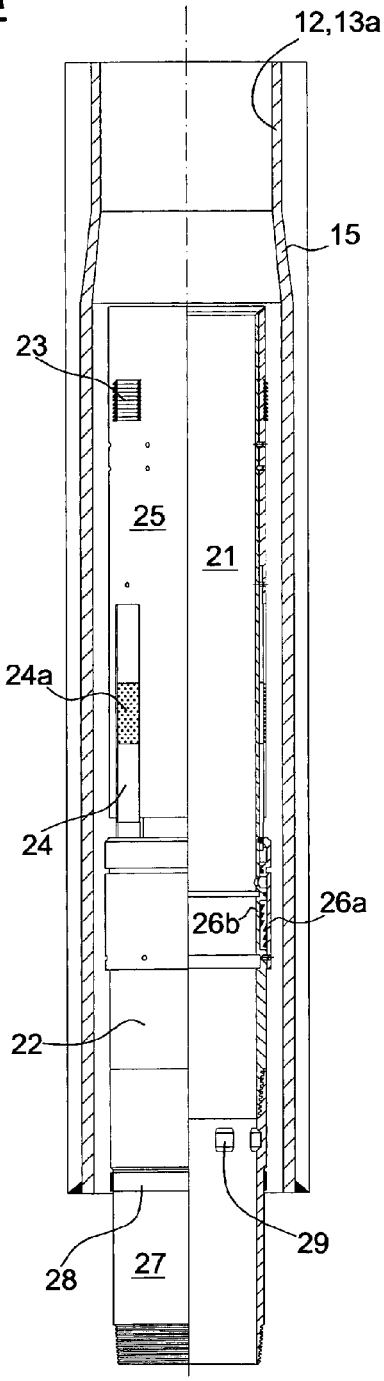
Figure 8:
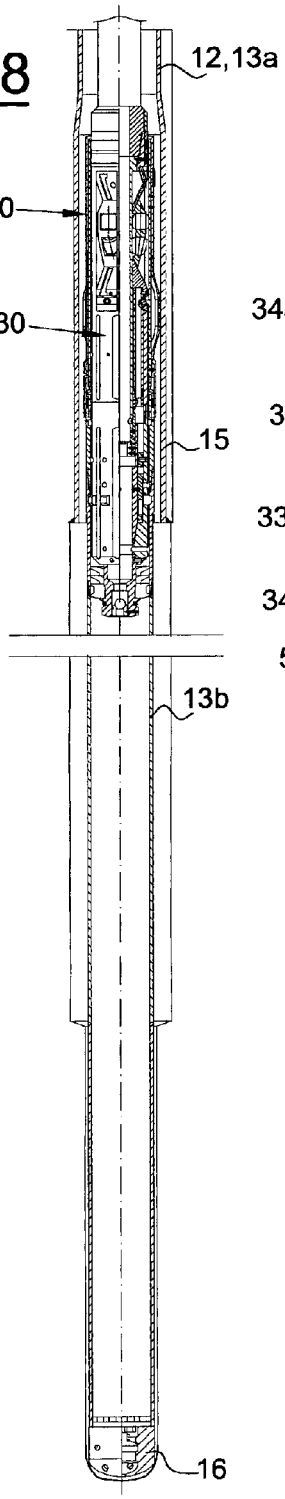
Figure 8A:
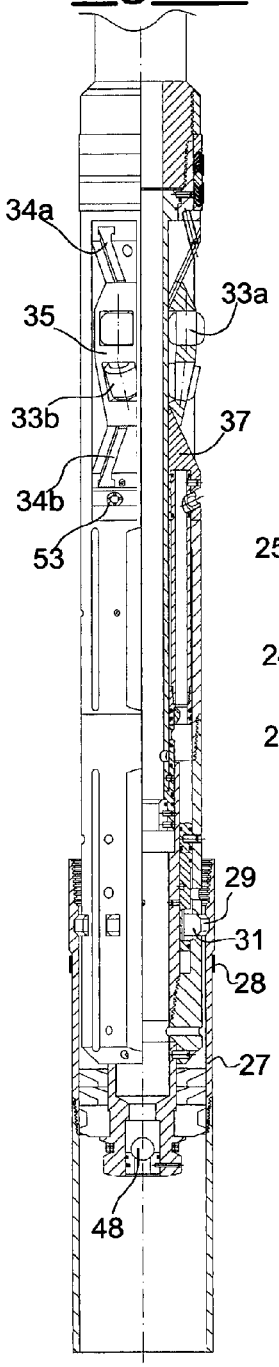
Figure 8B:
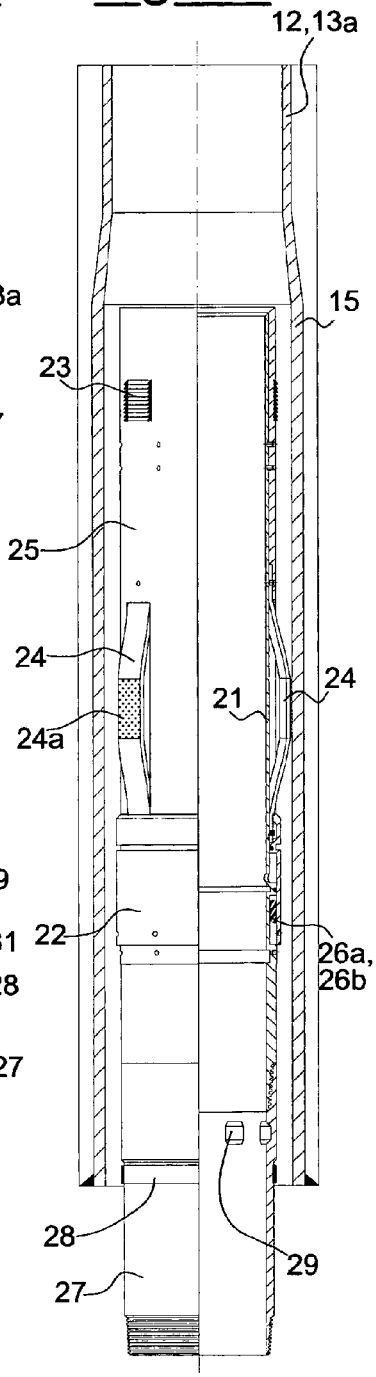
Figure 13:
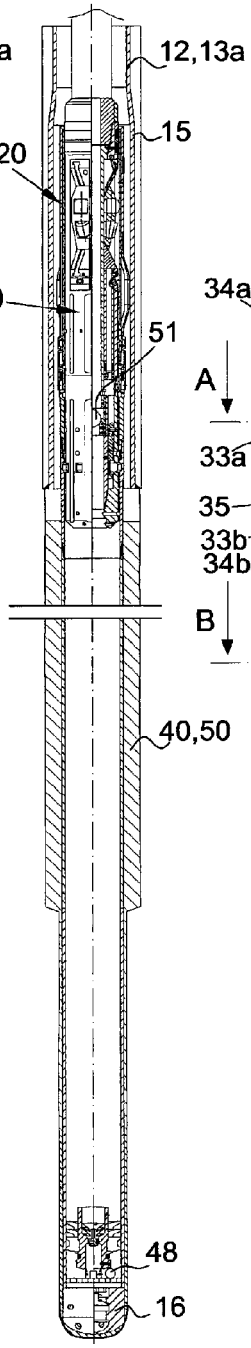
Figure 13A:
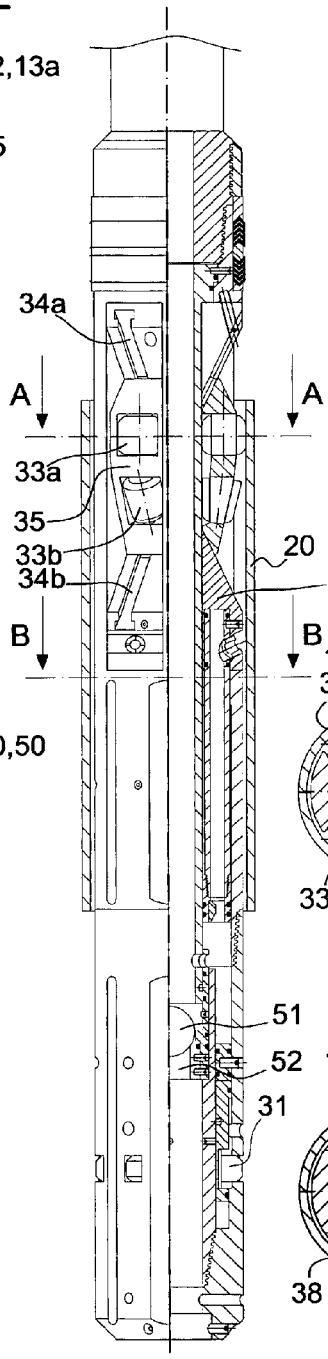
Figure 13B:
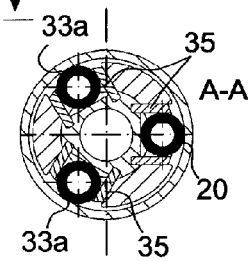
Figure 13C:
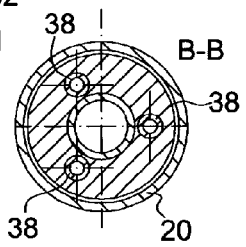
Figure 14:
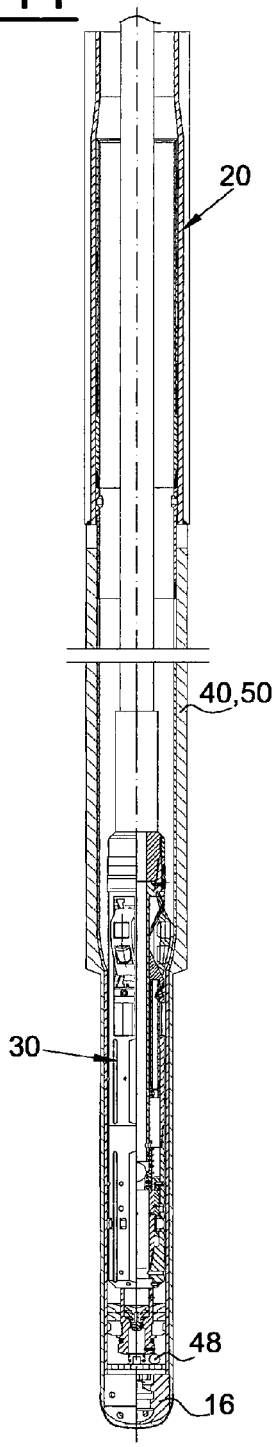
Figure 14A:
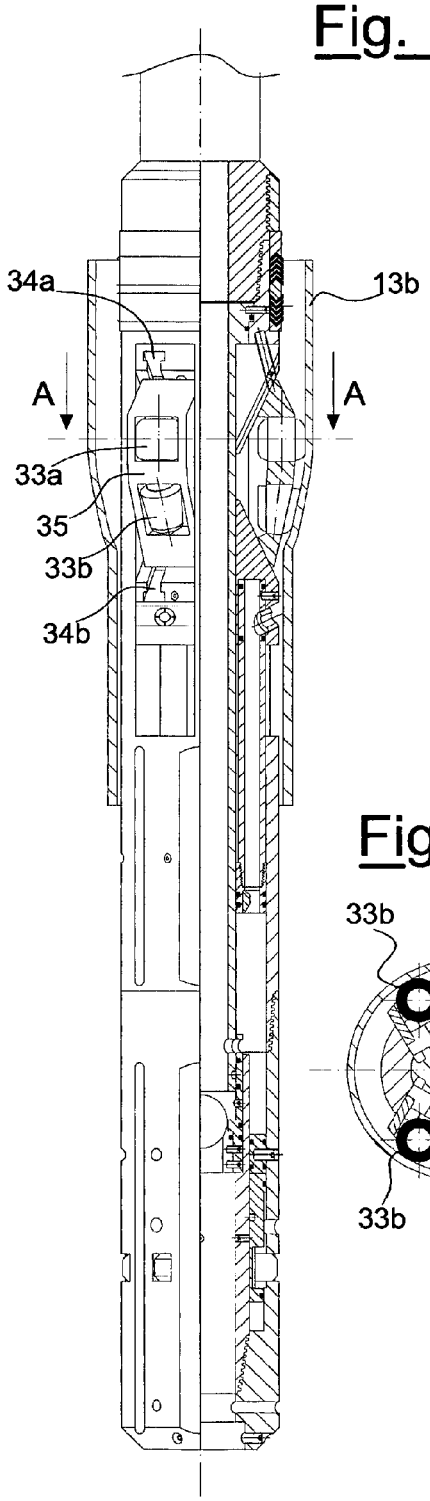
Figure 14B:
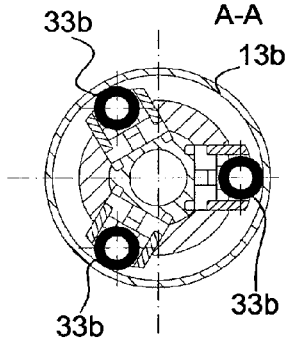
Figure 15A:
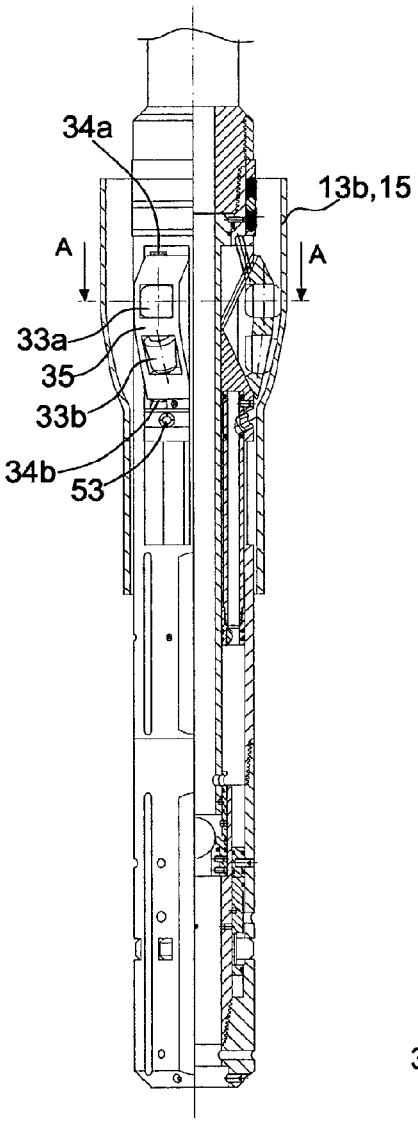
Figure 15:
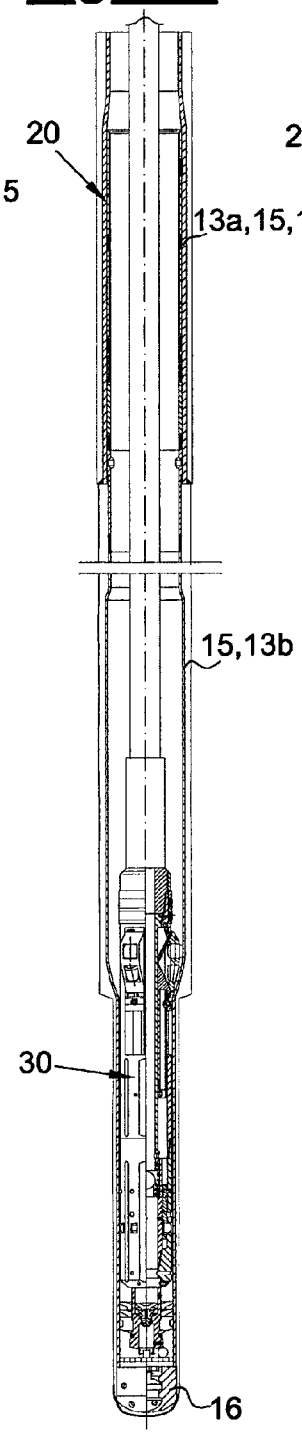
Figure 15B:
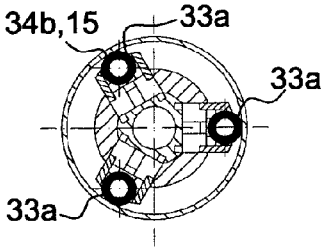
Figure 17:
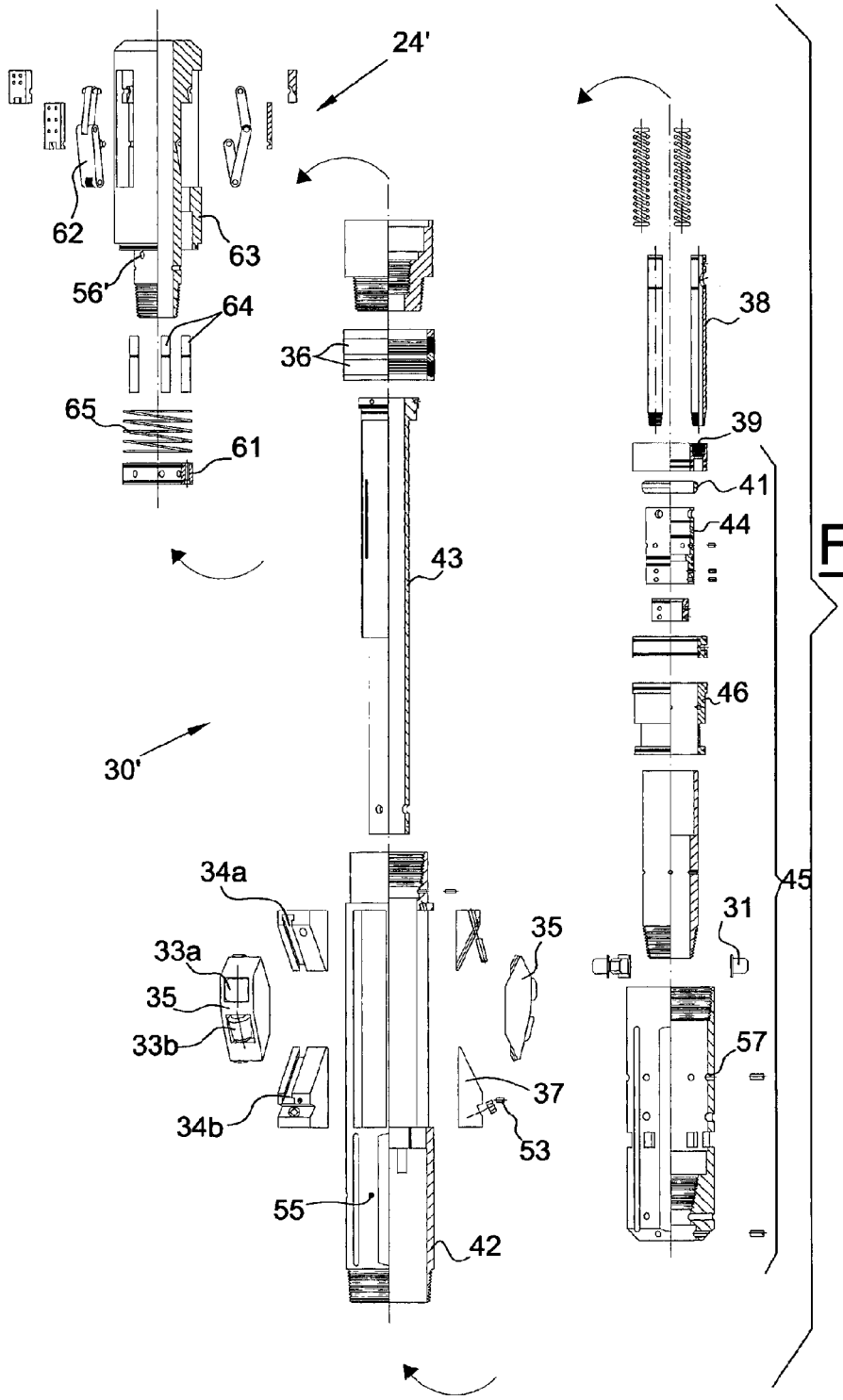
Figure 18:
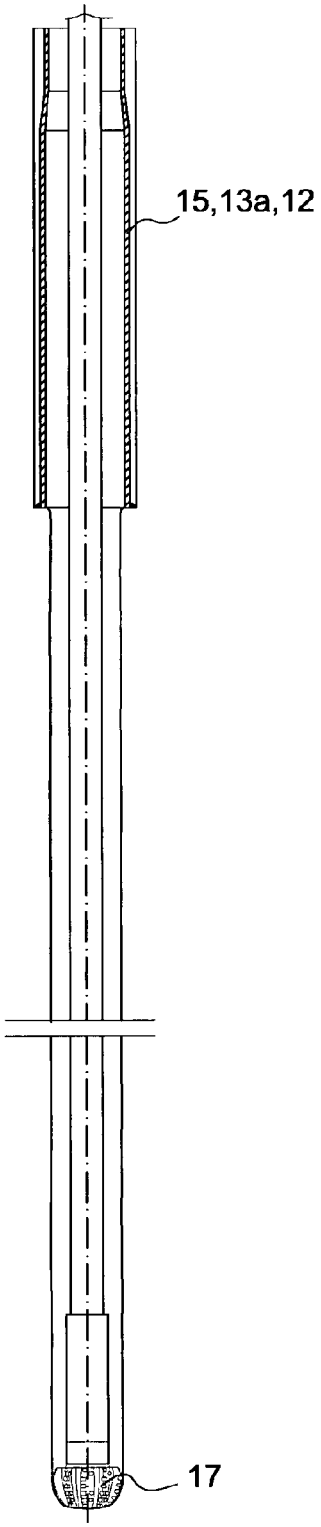
Figure 19:
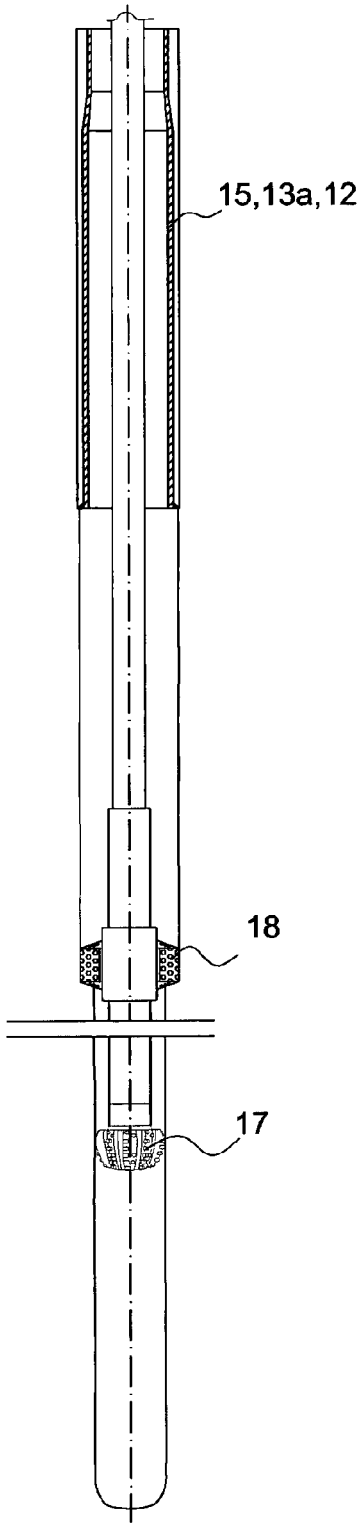
Figure 20:
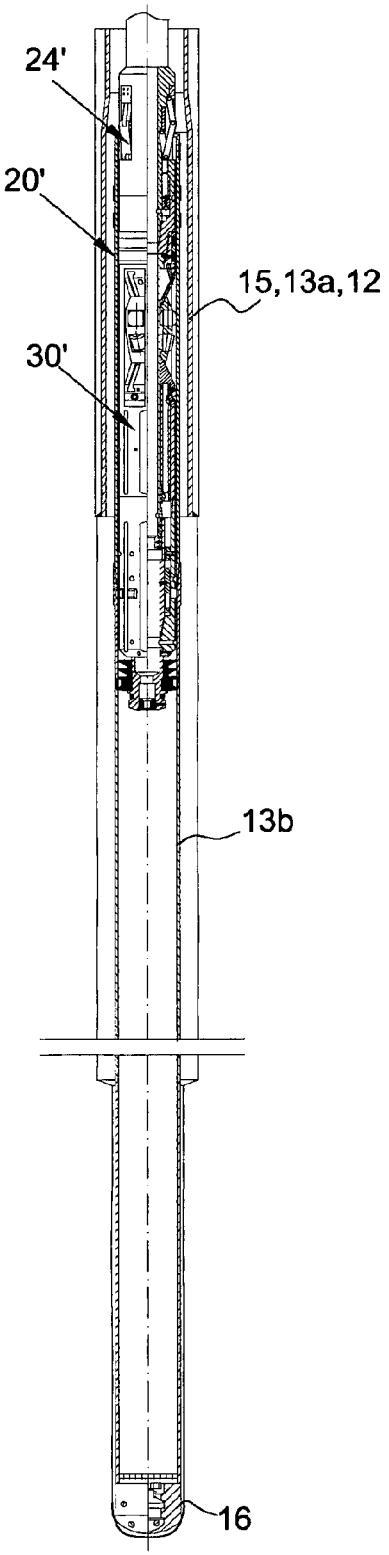
Figure 20A:
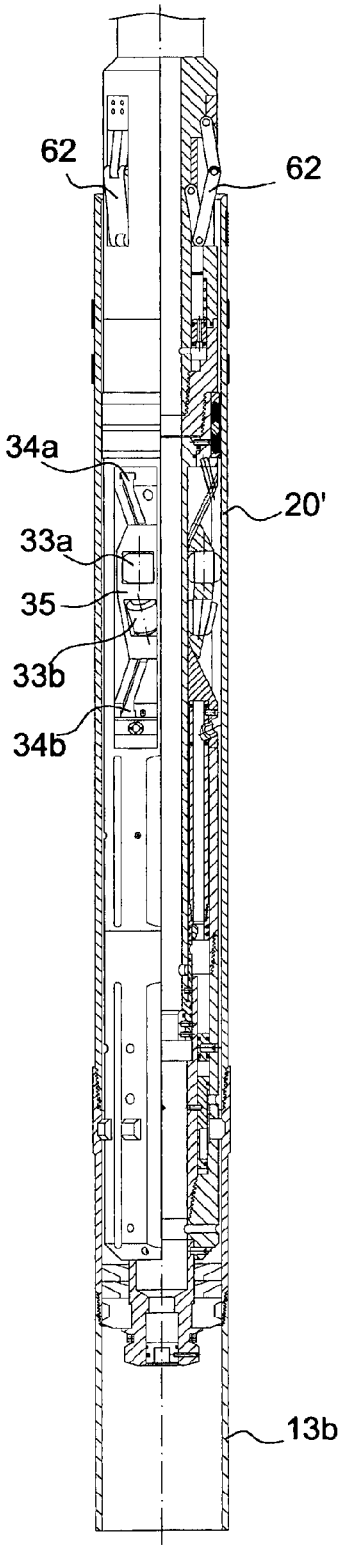
Figure 21:
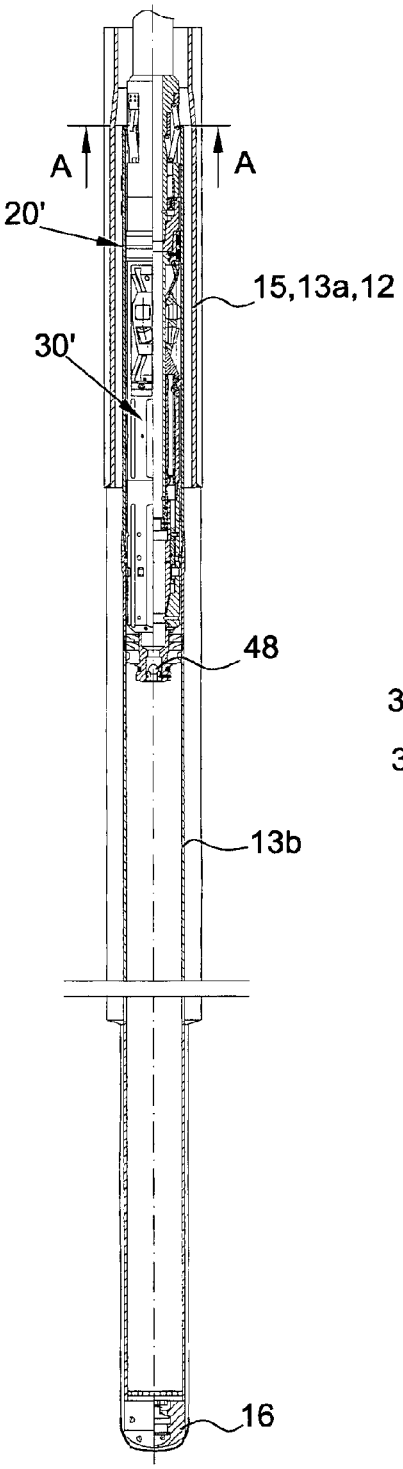
Figure 21A:
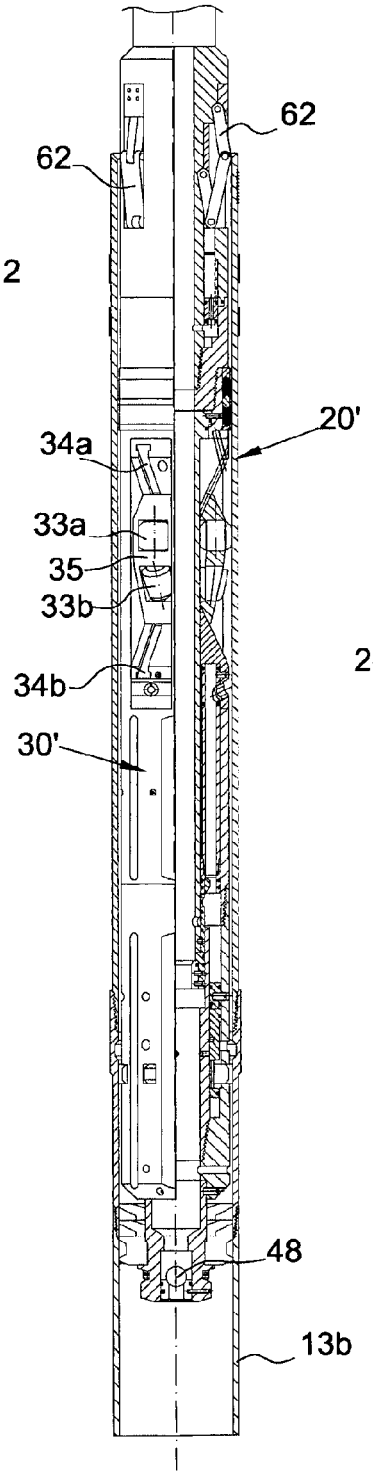
Figure 21B:
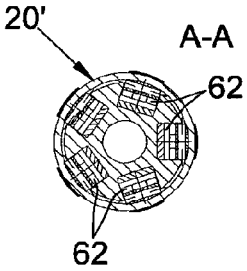
Figure 22:
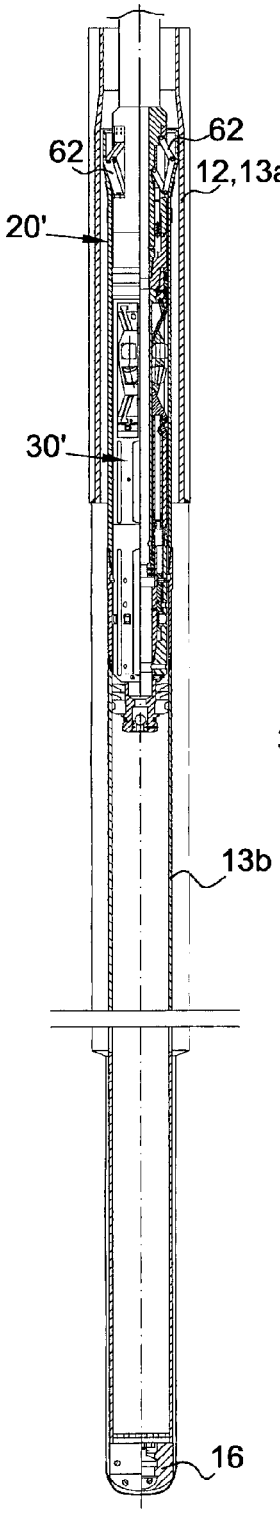
Figure 22A:
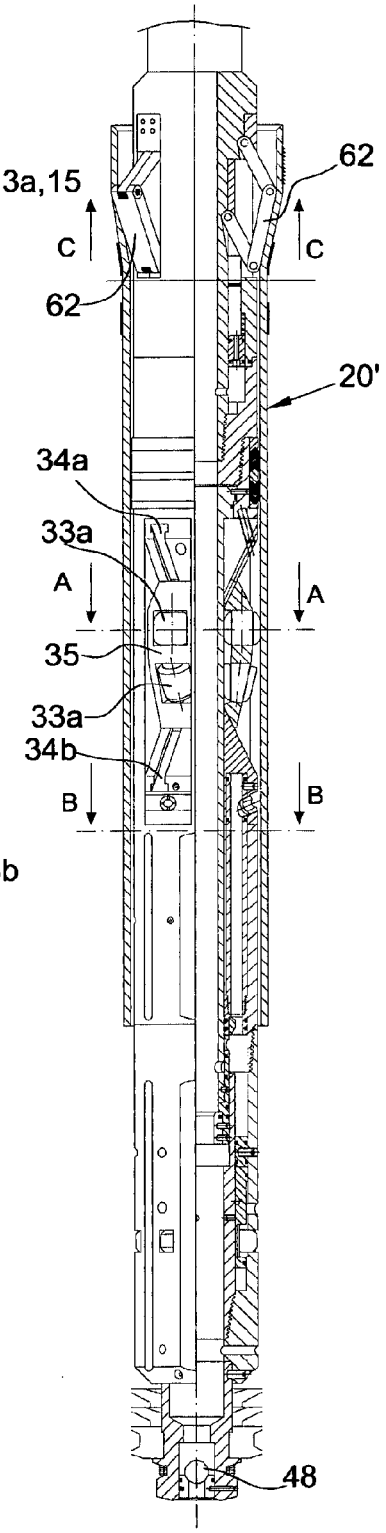
Figure 22D:
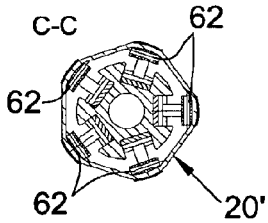
Figure 22B:
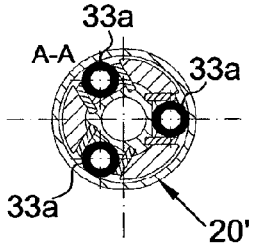
Figure 22C:
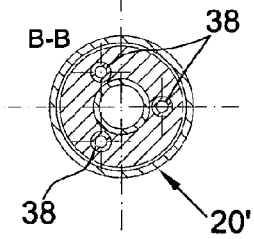
Figure 23:
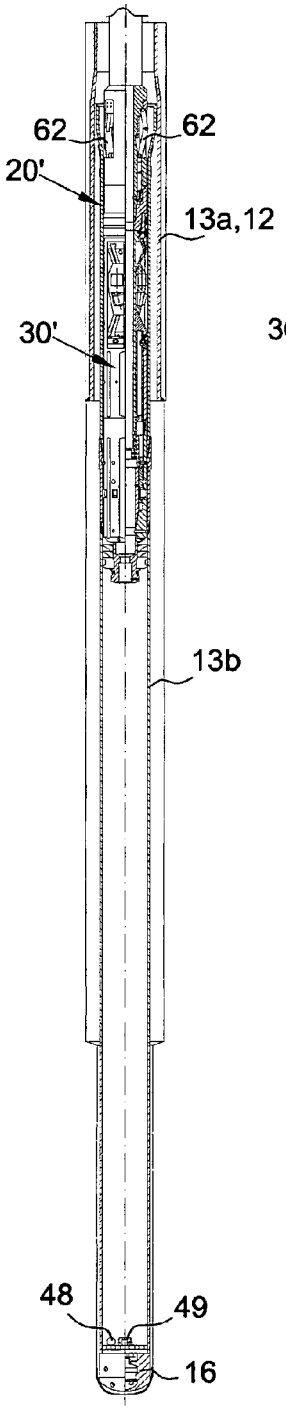
Figure 24:
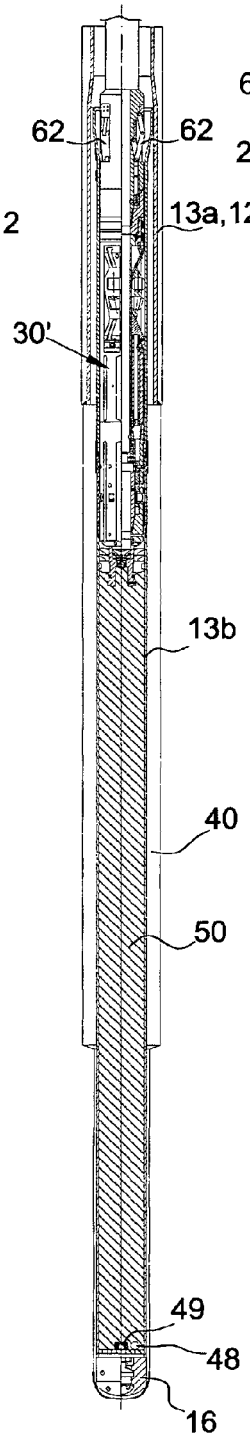
Figure 25:
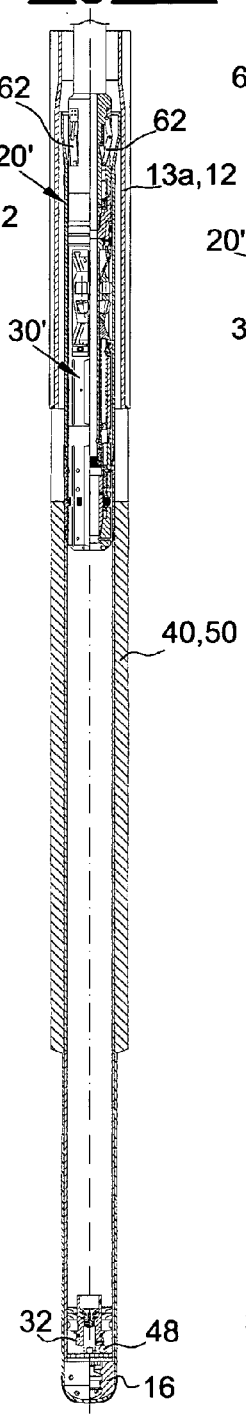
Figure 26:
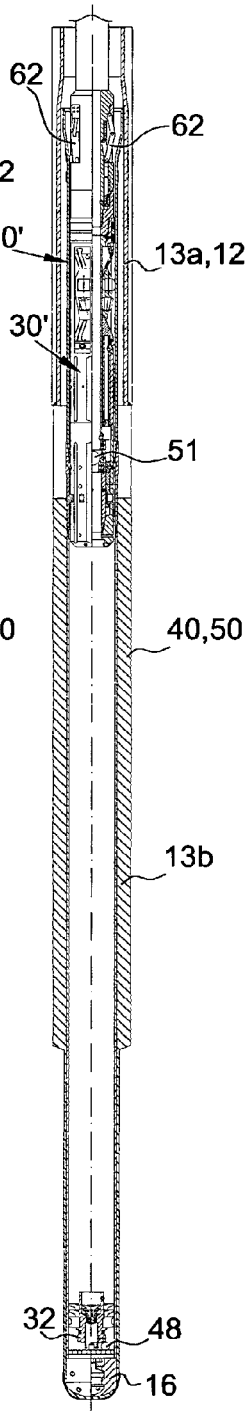
Figure 27:
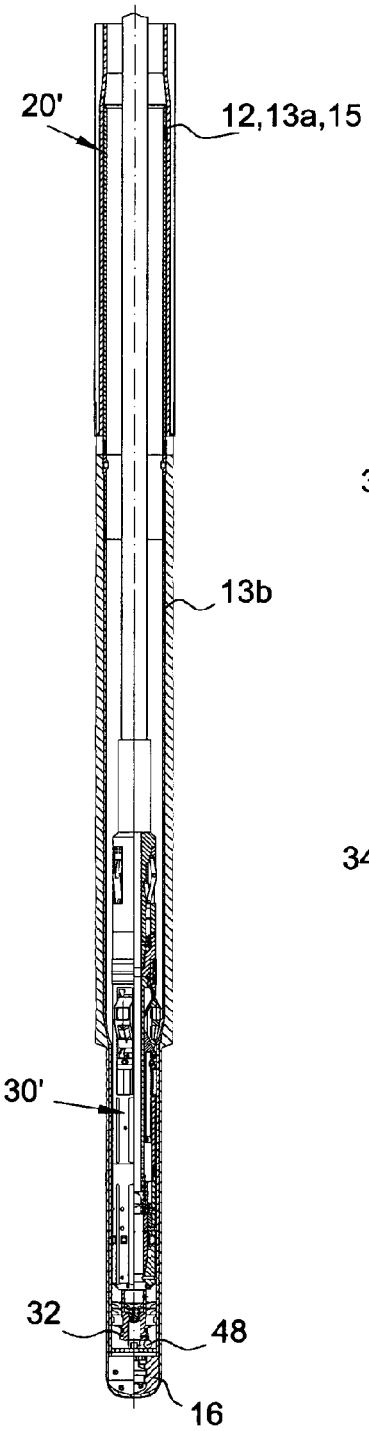
Figure 27A:
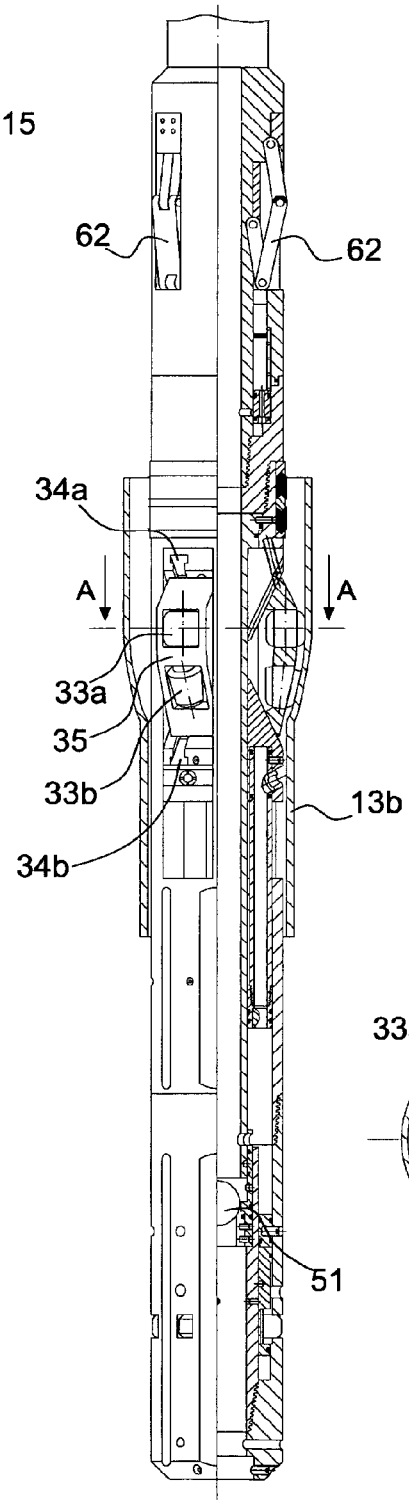
Figure 27B:
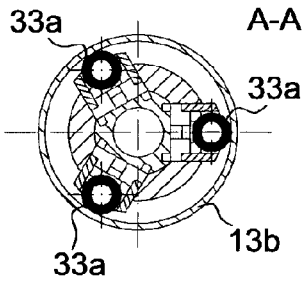
Figure 28:
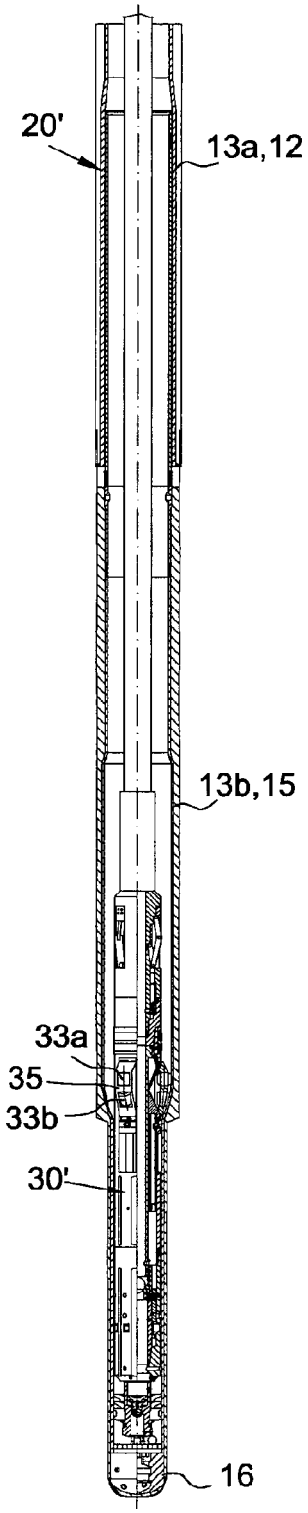
Figure 28A:
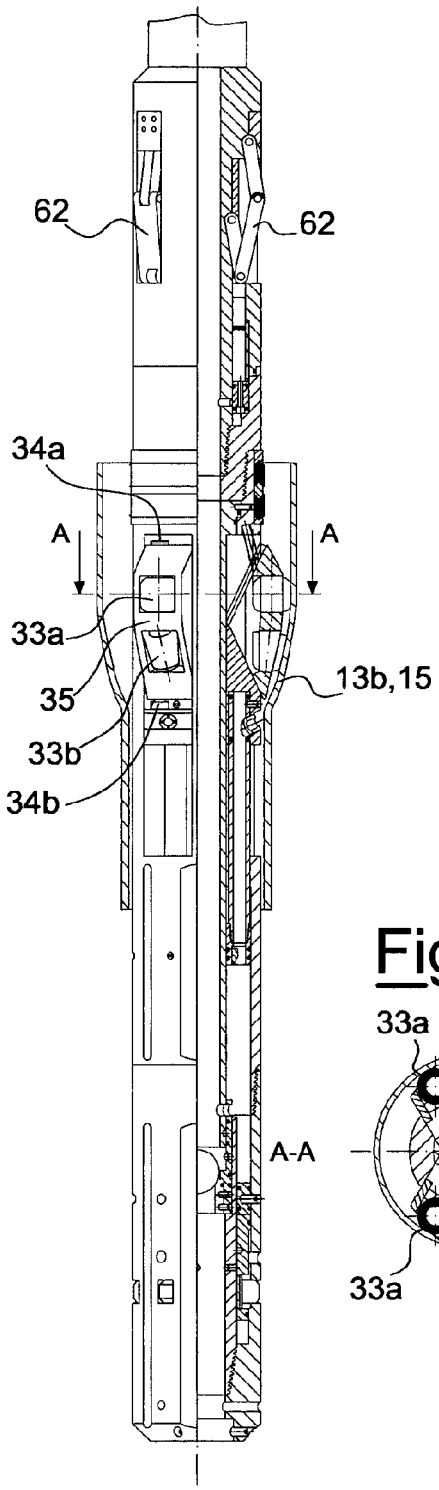
Figure 28B:
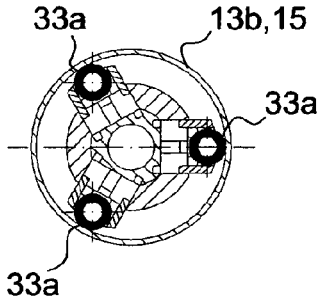
Figure 29:
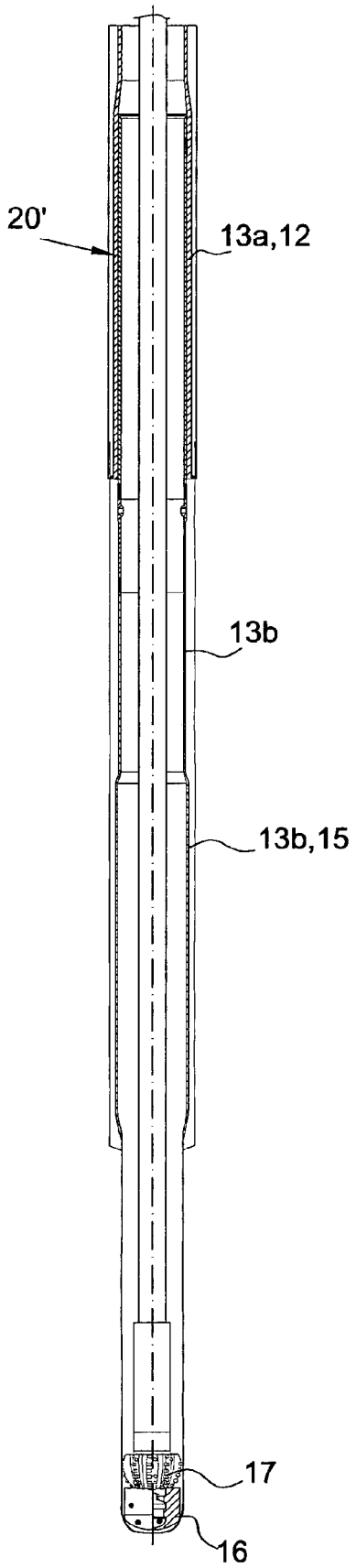

FIGS. 7*a*-7*b* are raised side-views of the expanding and anchoring devices in the configurations relating to the phases of FIG. 7;

FIGS. 8*a*-8*b* are raised side-views of the expanding and anchoring devices in the configurations of FIG. 8;

FIGS. 13*a*-13*c* are respectively a raised side-view of a section along the line A-A and a section along the line B-B of the expanding device in the configuration of FIG. 13;

FIGS. 14*a*-14*b* are respectively a raised side-view and a sectional view along the line A-A of the expanding device in the configuration of FIG. 14;

FIGS. 15*a*-15*b* are respectively a raised side-view and a sectional view along the line A-A of the expanding device in the configuration of FIG. 15;

FIG. 17 is an exploded view of an expanding device of a second embodiment of the anchoring and expanding unit according to the present invention;

FIGS. 18-29 represent the phases of the ground drilling method according to the present invention, using the anchoring and expanding unit of FIG. 17;

FIG. 20*a*, is a raised side-view of the anchoring and expanding unit in the configuration relating to the phase of FIG. 20;

FIGS. 21*a*-21*b* are respectively a raised side-view and a sectional view along the line A-A of the anchoring and expanding unit in the configuration of FIG. 21;

FIGS. 22*a*-22*d* are respectively a raised side-view, a sectional view along the line A-A, a sectional view along the line B-B and a sectional view along the line C-C of the anchoring and expanding unit in the configuration of FIG. 22;

FIGS. 27*a*-27*b* are respectively a raised side-view and a sectional view along the line A-A of the anchoring and expanding unit in the configuration of FIG. 27;

FIGS. 28*a*-28*b* are respectively a raised side-view and a sectional view along the line A-A of the anchoring and expanding unit in the configuration of FIG. 28.

With reference to the figures, these show an anchoring and expanding unit, for the production of a well, marked as a whole by 20, 30; 20', 30'.

In accordance with a first embodiment, the anchoring and expanding unit 20, 30, according to the present invention, comprises an anchoring device 20 and an expanding device 30, removably constrained to each other.

The anchoring device 20 is advantageously equipped with suspension means 24, 24*a* to a preceding column 12, 13*a*, 13*b*.

More specifically, the anchoring device 20 comprises an inner expandable tubular element 21, covered by an external tubular liner 22, 25, also expandable, made up of two parts, a fixed upper part 25 and a lower moveable part 22. The lower part 22 of the outer liner is equipped with sealing means, such as, for example, elastomeric seals to create a hydraulic circuit and act as actuator piston of a series of leaf springs 24 situated above the same and constrained to the upper part 25 of the outer liner.

The actuation of the leaf springs 24 takes place after the shearing of stop pins 56 which keep the lower part 22 of the outer liner in an initial position. Once the pins 56 have been sheared, the lower part 22 of the outer liner exerts a thrust on the lower portion of the leaf springs 24. This causes the arching of the leaf springs 24 (open position) which strike against the inner wall of the upper column 12, 13*a*, 13*b* in which the anchoring device 20 is housed.

The leaf spring portion 24 which strikes against the inner wall of the upper column 12, 13*a*, 13*b* is preferably equipped with a series of first protuberances 24*a*, for example slips, which are engaged with said inner wall.

Second protrusions 26*a*, 26*b*, suitable for cooperating with each other to keep the lower part 22 of the outer liner raised, therefore blocking the leaf springs 24 in an open position, are envisaged on the outer surface of the inner tubular element 21, and inside the lower part 22 of the outer liner.

The second protrusions 26*a*, 26*b* are preferably made of a soft material so that the fixing of the leaf springs 24 collapses during the expansion of the anchoring device 20.

The lower part 22 of the outer liner is preferably hydraulic to effect the fixing of the leaf springs 24.

The outer liner 22, 25 is preferably provided with third protrusions 23, preferably wedge-shaped and made of a hard metal to increase the anchoring of the anchoring device 20 to the upper column 12, 13*a*, 13*b*.

A second expandable tubular element 27 is also constrained to the inner tubular element 21, comprising inner recesses 29 for coupling with the expanding device 30 and outer sealing means 28, such as, for example, elastomeric seals for the hydraulic seal with the upper column 12, 13*a*, 13*b*.

A lower intermediate column 13*a*, 13*b*, 13*c* of the expandable type is constrained, through a threaded connection, to said second tubular element 27.

The expanding device 30 is housed inside the anchoring device 20, which is initially removably constrained to the same by the action of hydraulic fixing means 31.

The expander 30 preferably includes mechanical fixing means (not shown) which operate in the case of the non-functioning of the hydraulic fixing means 31.

The expanding device 30 is also externally equipped with sealing means 36, such as, for example, elastomeric seals to effect the hydraulic seal between the same 30 and the anchoring device 20.

The hydraulic fixing means 31 are preferably envisaged in the lower portion 45 of the expanding device 30. They include a series of radially movable dogs 31 which are initially kept protruding buffering, inside the expanding device 30, against a first sleeve 46 which prevents them from withdrawing.

The first sleeve 46 can be longitudinally translated along the main expansion direction of the expander 30. A translation of this first sleeve 46, which is such that the wall of the sleeve 46 no longer interferes with the movable dogs 31, allows them to withdraw inside the body of the expander 30, releasing them from the inner recesses 29 present in the second tubular element 27 of the anchoring device 20 with which they were cooperating in order to guarantee the coupling between the expanding device 30 and the anchoring device 20.

The expanding device 30 also includes a cementation plug 32 equipped with shearing pins 54.

According to the present invention, the expanding device 30 comprises a series of extractable expanding means 33*a*, 33*b*, which can be stopped in at least two different operative positions in which said expanding means 33*a*, 33*bb*, are extracted.

In the particular embodiments shown, the expander includes, in the upper side, a series of pads 35 which house said expanding means, such as, for example, off-line rolls 33*a*, 33*b*. Each of the pad 35 is preferably equipped with a first upper cylindrical roll 33*a* and a second lower conical roll 33*b*.

The presence of the two off-line rolls 33*a*, 33*b* allows a progressive expansion to be effected of the coating column 13*a*, 13*b*, 13*c*, in two phases. In particular, the lower conical rolls 33*b* form a portal, during the first expansion phase, which facilitates the second expansion phase.

Each pad 35 preferably has a cage structure to include and protect the rolls 33*a*, 33*b*.

The pads 35 are actuated, for example hydraulically, to slide along a pair of tilted guides 34*a*, 34*b*, by means of a protrusion having a swallow-tailed profile.

In particular, a first guide 34*b* is situated on a wedge-shaped body 37, which can be translated along the main development direction of the expanding device 30. The action exerted by the translation of the first guide 34*b* towards a second guide 34*a*, assembled in a fixed position on a first external tubular body 42, exerts a thrust on the relative pad 35, which causes it to radially advance outwardly.

Figure 3:
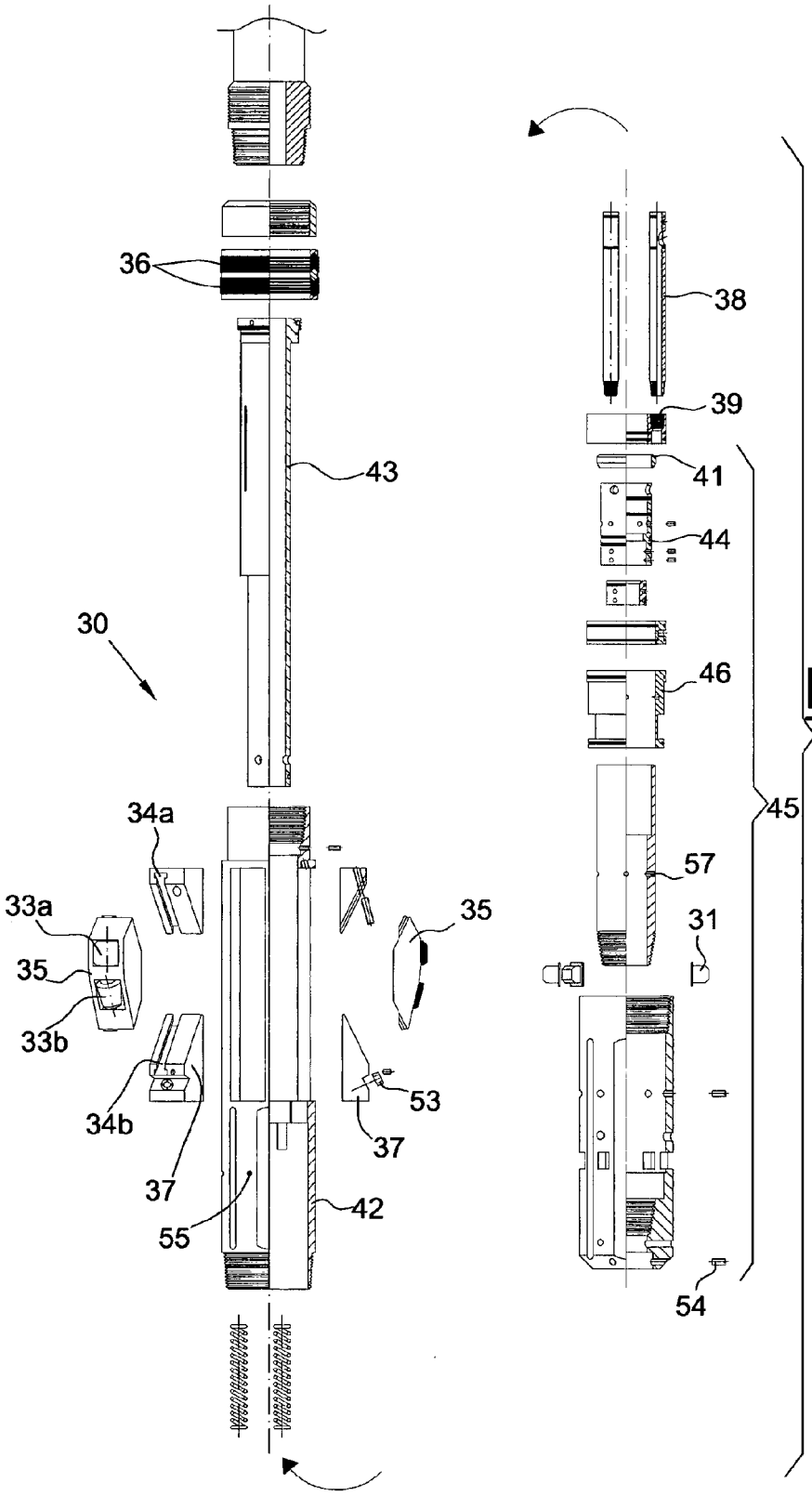
FIG. 3 is an exploded view of an expanding device according to a first embodiment of the anchoring and expanding unit of the present invention.
Figure 4:
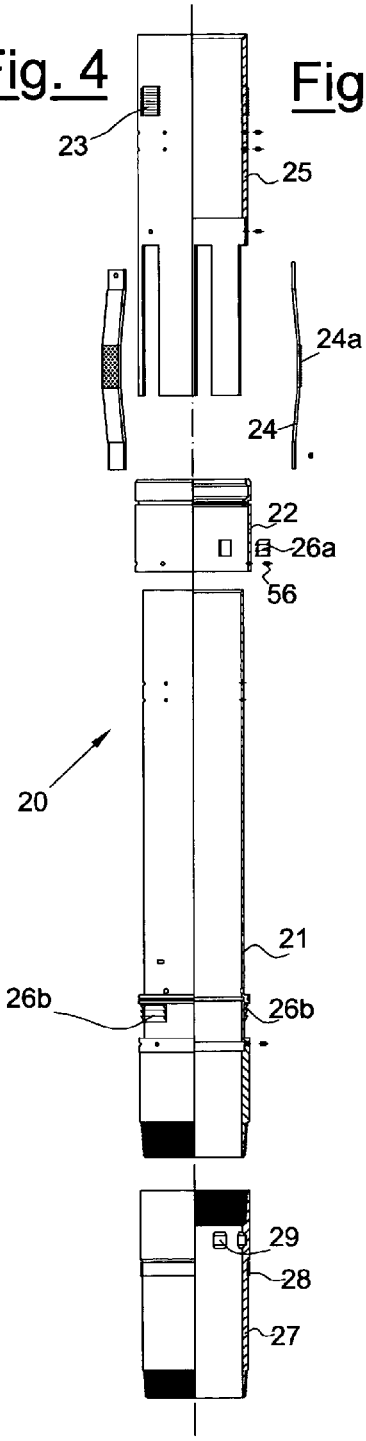
FIG. 4 is an exploded view of an anchoring device according to the first embodiment of the anchoring and expanding unit of the present invention.

In the embodiment shown in FIG. 3, the wedge-shaped bodies 37 are hydraulically translated. For this purpose, these bodies 37 are each constrained to a tubular rod 38, supported by an annular body 39 equipped with a narrowing ring 41 which creates a seal chamber between the first outer tubular body 42 and a second inner tubular body 43. Thanks to the pressure drops induced by a choke 53 and said narrowing ring 41, the axial excursion which radially pushes the rolled pads 35, proves to be advantageously greater with respect to traditional transversal hydraulic pistons.

In this embodiment, the wedge-shaped bodies 37 act upwardly, i.e. in the opposite direction with respect to the advancing of the expanding device 30, thus also exploiting the weight discharged by the drill pipes during the enlargement of the column 13*a*, 13*b*.

Furthermore, the wedge mechanism 37 allows, with respect to traditional radial hydraulic pistons, a much wider transversal excursion capacity.

The elements contributing to the radial protrusion of the rolls 33*a*, 33*b* are activated and regulated by the circulation of the drilling fluid and ceases with it, to allow said rolls 33*a*, 33*b* to re-enter during the extraction phase of the expanding device from the battery.

According to the present invention, stop pins 55 are also envisaged, which initially limit the stroke of the translatable wedge-shaped body 37 and therefore the radial protrusion of the pads 35, so that the rolls 33*a*, 33*b* are blocked in a first operative position in which they are extracted with respect to the expanding device. When the wedge-shaped body 37 is in the first limit position determined by the stop pins 55, the expanding device 30 is capable of effecting the expansion of the columns 13*a*, 13*b*, 13*c* to a first diameter.

The breakage of the stop pins 55, on the contrary, allows the pads 35 to protrude further and bring the rolls 33*a*, 33*b* to a second operative position in which said rolls 33*a*, 33*b* protrude even further from the expanding body 30, thus being able to effect a high expansion of a portion 15 of column to a second diameter which is greater with respect to said first diameter.

A second protection sleeve 44 is preferably envisaged, for the protection of the set of elements which contribute to the protrusion of the rolled pads 35, which is activated only after cementation.

The functioning of the anchoring and expanding unit according to the present invention, will now be described with respect to the drilling phases of a well, which can be implemented together with the same.

Following the traditional installation of a conductor pipe 11, the drilling of the surface phase takes place. The surface column 12 preferably has, in its lower part, a portion with a larger diameter, also called bell 15. The diameter of the bell 15 is selected so that it can house the anchoring and expanding unit 20, 30 according to the present invention, in its interior.

The installation of a conductor pipe 11 and a surface column 12 of the traditional type allows the use of standard wellheads and safety equipment (BOP).

The length of the bell 15 is programmed so as to have a sufficient overlapping between the columns 12, 13*a*, 13*b*, 13*c* and allows a good insulation with the elastomeric seals and cement.

A hundred meters are generally adequate.

According to the present invention, for each drilling and casing running phases of the intermediate columns 13*a*, 13*b*, 13*c*, two distinct expansion phases substantially take place, in which, during a first phase, there is the expansion of the intermediate column 13*a*, 13*b*, 13*c* to a first diameter and, subsequently, a second expansion occurs of the lower portion 15 of said column, to a second larger diameter with respect to the first diameter.

More specifically, the laying and start-up of an intermediate column during the drilling of a well are effected as follows.

Figure 5:
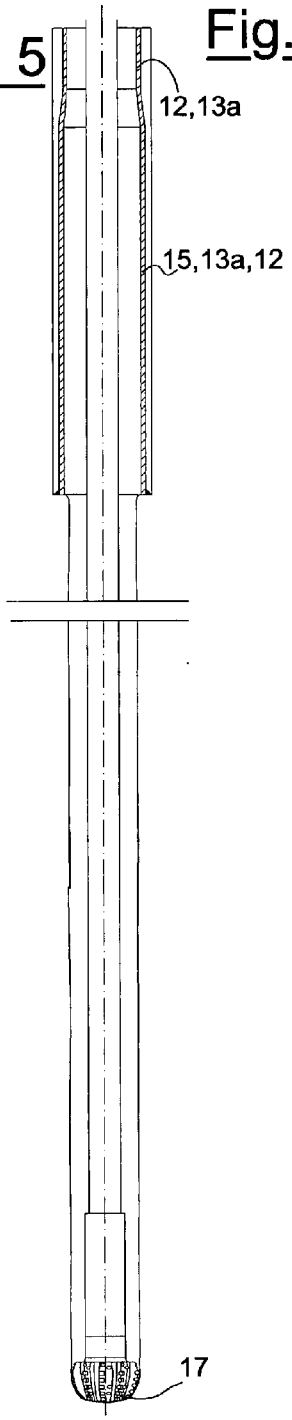
FIGS. 5-16 represent phases of the drilling method according to the present invention, using the anchoring and expanding unit of FIGS. 3 and 4.
Figure 6:
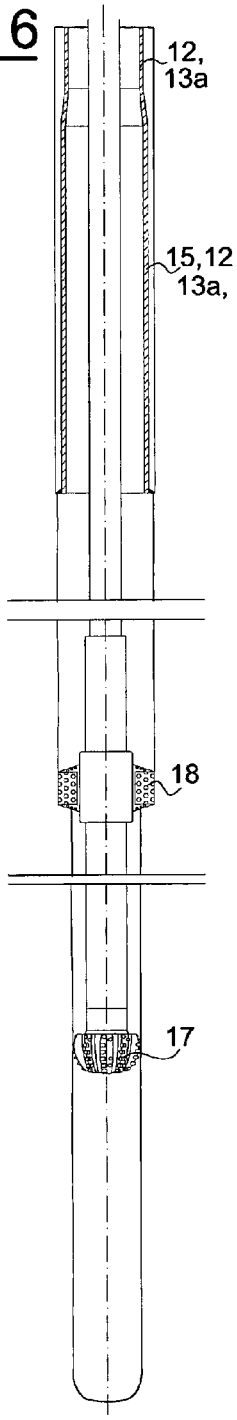

First of all drilling is effected, illustrated in FIG. 5, together with the enlargement of the hole obtained by the drilling, illustrated in FIG. 6. For greater illustrative clarity, these phases are shown in succession, however they can also be carried out simultaneously.

The diameter of the hole obtained by drilling is such as to allow the housing of an intermediate column 13*a*, 13*b*, 13*c*, which has not yet expanded. The enlargement of this hole has the purpose of facilitating the expansion of the intermediate column 13*a*, 13*b*, 13*c*, also leaving a hollow space sufficient for the cementation.

These drilling and enlargement phases are effected by traditional techniques and tools, such as a bit 17 and an underreamer 18.

The subsequent column 13*a*, 13*b*, 13*c* of the expandable type is lowered until it rests on the bottom of the hole obtained during the drilling phase.

This column 13*a*, 13*b*, 13*c* contains accessory equipment, such as a shoe and plugs, of the traditional type or similar. The shoe 16 is made of a material completely drilleble.

The intermediate column 13*a*, 13*b*, 13*c* is run into the well in the traditional way, through a battery of drill pipes connected to the expanding device 30 according to the present invention. The intermediate column 13*a*, 13*b*, 13*c*, as mentioned above, is in fact constrained to the anchoring device 20, which is firmly connected to the expanding device 30 though the hydraulic fixing means 31 described above, which guarantee a high sturdiness of the whole unit and therefore the possibility of pushing or rotating the intermediate column 13*a*, 13*b*, 13*c* during its running.

The hydraulic seal between the expanding device 30 and intermediate column 13*a*, 13*b*, 13*c* is ensured by the elastomeric seal 36 outside the expander 30, which act against the inner wall of the anchoring device 20. Thanks to these elastomeric seals 36, it is possible to circulate the drilling fluid during the running of the intermediate column 13*a*, 13*b*, 13*c* towards the bottom.

As illustrated in FIG. 8, in a subsequent phase, the first ball 48 is thrown, and the same is housed in the specific housing 49 inside the second cementation plug 32, at the bottom of the expander 30.

It is therefore possible to pressurize the inside of the rods, for example at a pressure of about 8.3 MPa (1,200 psi), in order to shear the stop pins 56 of the lower part 22 of the outer fixing liner of the anchoring device 20. This pressurization causes the upward sliding of said lower portion 22 and consequently the anchoring of the protrusions 24*a* present on the leaf springs 24 against the inner wall of the bell 15.

In this case, the anchoring of the intermediate column 13*a*, 13*b*, 13*c* to the preceding column 12, 13*a*, 13*b*, does not serve to sustain the weight of the same 13*a*, 13*b*, 13*c*, but only to provide the initial reaction to the rotation of the battery of drill pipes and expander device 30, integral with it, during the subsequent expansion phase.

The compression constraint of the intermediate column 13*a*, 13*b*, 13*c* at the well bottom is preferable in order to facilitate the subsequent expansion and improve the mechanical resistance of the columns.

Figure 9:
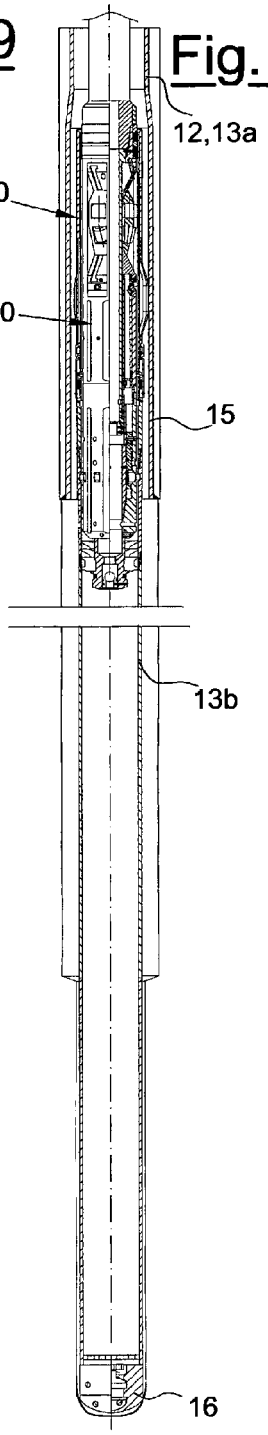

By further increasing the pumping pressure, to about 10.3 MPa (1,500 psi) for example, the stop pins 57 of the hydraulic fixing means 31 of the toothed mechanism are sheared. The first sleeve 46 of the expander 30 then slides upwards, and the expander 30 is released from the anchoring device 20 and consequently from the intermediate column 13*a*, 13*b*, 13*c*, as shown in FIG. 9.

By removing a portion of weight of the manoeuvring battery before the release of the expander 30, a lowering of the battery, after the release, can be observed.

Figure 10:
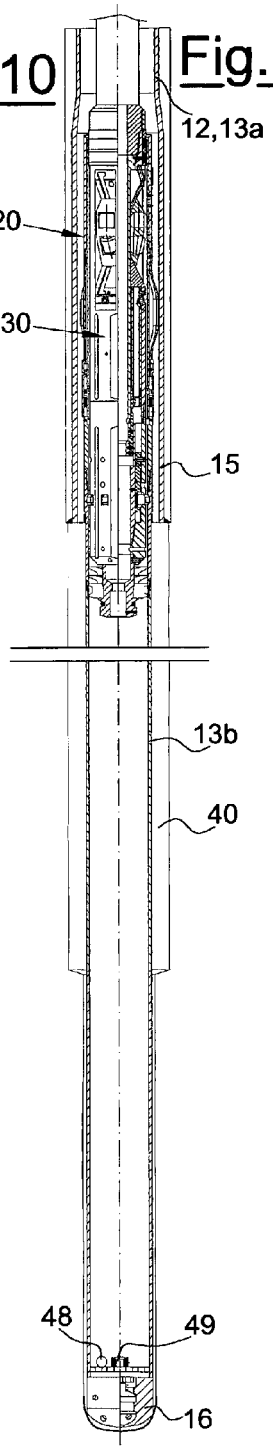

There is subsequently a further increase in pressure to about 12.4 MPa (1800 psi) for example, to expel the ball 48 and its housing 49, which fall to the bottom as shown in FIG. 10.

Figure 11:
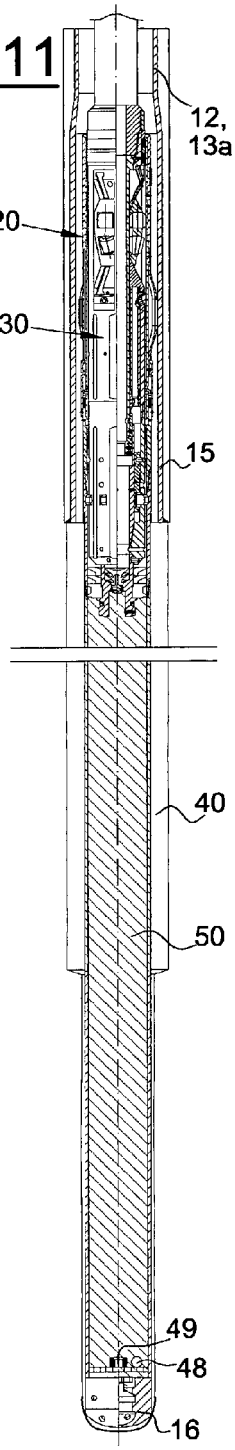

This is followed by the cementation of the intermediate column 13*a*, 13*b*, 13*c* by the passage of a suitable gripping material 50, such as, for example, mortar, introduced through the drill pipes towards the inside of the intermediate column 13*a*, 13*b*, 13*c*, as shown in FIG. 11.

Figure 12:
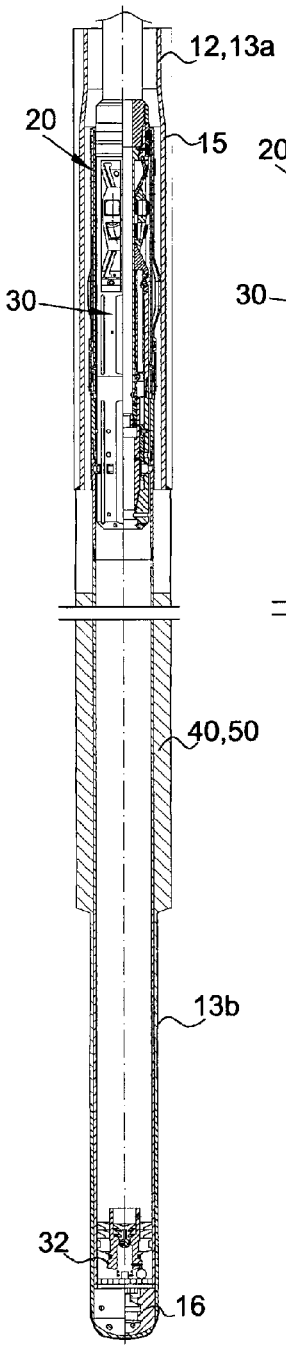

The pumping pressure of the gripping material 50 breaks the shearing pins 54 through which the plug 32 is anchored to the bottom of the expanding device 30, which falls to the bottom of the intermediate column 13*a*, 13*b*, 13*c* pushing the gripping material 50 into the annular space 40 formed by the same 13*a*, 13*b*, 13*c* with the well wall (see FIG. 12).

Before the solidification of the gripping material (cement) 50, the expansion takes place of the intermediate column 13*a*, 13*b*, 13*c*, constrained in compression to the bottom.

The expansion of the intermediate column 13*a*, 13*b*, 13*c* takes place downwards through the rotation of the specific expander 30 enabled by the anchoring of the intermediate column 13*a*, 13*b*, 13*c* to the preceding column 12, 13*a*, 13*b*, by means of the specific suspension means 24. There is a decrease in the forces, with respect to a fixed expander, and therefore of the damage on the inner wall of the columns. This effect is further improved by the double line of rolls 33*a*, 33*b*, with which the expander 30 is equipped, according to the present invention. Furthermore, the off-line positioning of the rolls 33*a*, 33*b*, assures a softer enlargement, in two phases: whereas, as already mentioned above, the lower conical rolls 33*b* form a portal for discharging and reducing the load necessary for the advancing, the upper cylindrical rolls 33*a* ensure the final diameter and an optimum calibration.

The expander 30 is firstly slightly raised through the drill pipes. In this way the elastomeric seals 36 of the expander are released from the inner wall of the anchoring device 20 and the rolled pads 35 are positioned in correspondence with the upper end of the same device 20.

In this way, fluid can be circulated to remove any possible excess of gripping material (cement) 50.

The second ball 51 is then thrown, as illustrated in FIG. 13, which, once it has reached its housing 52, isolates the upper part of the expanding device 30 from the lower part 45. It is then possible to pressurize the inside of the rods, for example at about 17.2 MPa (2,500 psi), so that the fixing pins 58, which keep the second sleeve 44 of the expander 30 in position, are sheared.

The sliding of the second sleeve 44, connected to the housing 52 of the ball 51, causes the lifting of the support rods 38 of the wedge-shaped bodies 37 and therefore the radial protrusion of the pads 35.

The enlargement of the intermediate column 13*a*, 13*b*, 13*c* is effected through the rotation imposed to the expander 30 with the rolls 33*a*, 33*b* protruding through the drill pipes.

The expansion is first exerted towards the upper part of the anchoring device 20. Under this action, the second protrusions 26*a*, 26*b*, which hold the leaf springs 24 in an anchoring position, yield slightly, whereas the protrusions 23 envisaged on the outer wall of the anchoring device 20, create a further constraint between the preceding intermediate column 12, 13*a*, 13*b* and said device 20. The expansion proceeds along the whole length of the intermediate column 13*a*, 13*b*, 13*c* as shown in FIG. 14.

In this sense, the expanding device 30 has the contemporaneous function of installing the expandable column and enlarging it.

Once the bottom has been reached, the circulation of the drilling fluid is stopped to allow the rolled pads 35 to re-enter, the battery is pulled out by about a hundred meters and the downward enlargement of the bell 15 is effected.

The circulation flow-rate is increased for this purpose to obtain a higher thrust on the wedges 37 and break the stop pins 55 which, as they are positioned along the axial sliding of the annular body 39, limit its excursion and consequently the radial enlargement of the pads 35.

Once the maximum radial expansion of the sliding blocks 35 has been reached, the bell 15 is produced, which houses the anchoring and expanding unit, to make a following well portion. This phase is illustrated in FIG. 15.

When the enlargement is complete, if it is necessary to restore accessibility of the central hole of the expander 30, it is sufficient to increase the pressure to expel the second ball 51 and its housing 52 at the bottom.

Figure 16:
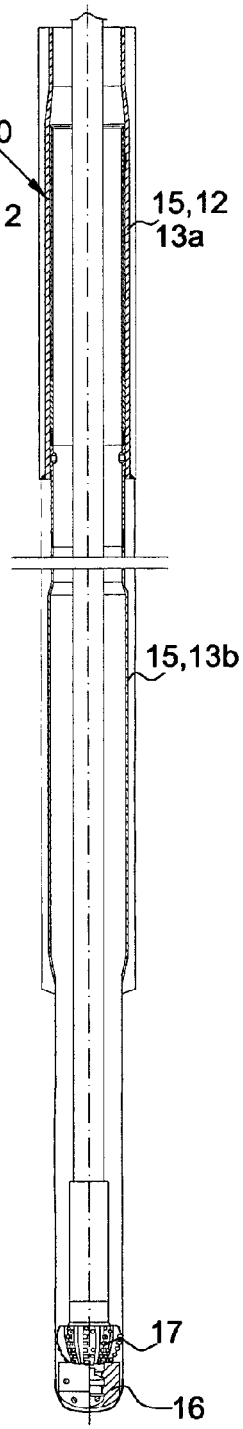

When the cement at the outside of the intermediate column 13*a*, 13*b*, 13*c* solidified, the milling of the shoe is effected, as shown in FIG. 16, to initiate the formation of a following portion of the well.

Thanks to the anchoring and expanding unit 20,30, which allows expansions at different diameters to be produced, it is possible to produce a bell 15, without the necessity of reducing the diameter of the subsequent column 13*a*, 13*b*, 13*c*. The reduction of the diameters used with respect to traditional diameters, advantageously causes a first reduction in the time and costs for drilling the well. Furthermore, the particular devices 20,30 used allow the bell 15 to be produced with operational continuity, with no time waste and subsequent specific operations. It is possible to effect the expansion operations when the cement behind the columns is still liquid.

The vibrations induced by the rotations of the drill pipes during the expansion advantageously improve the cementation quality.

Figure 1A:
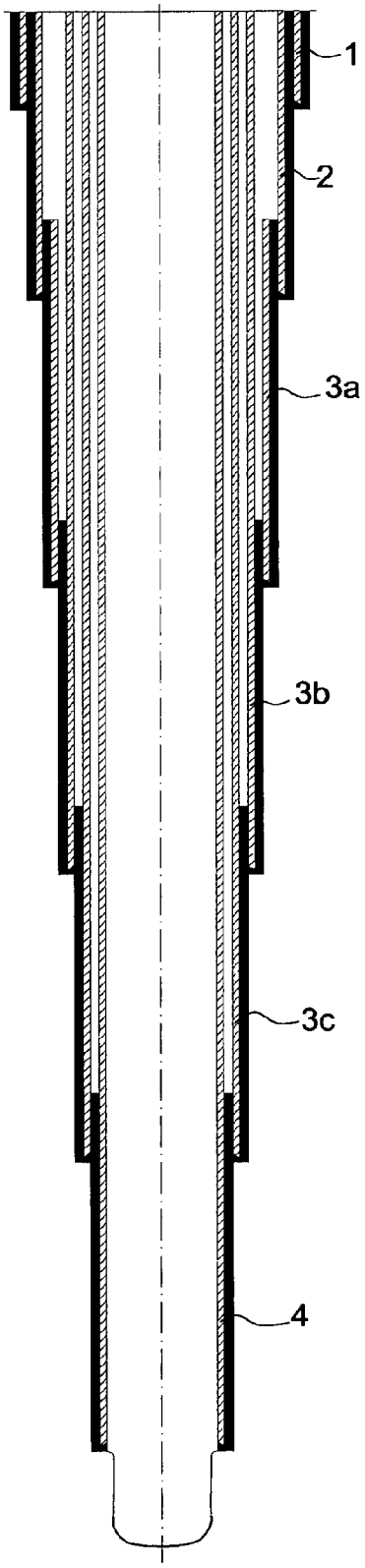
Fig. 1a PRIOR ART
Figure 1B:
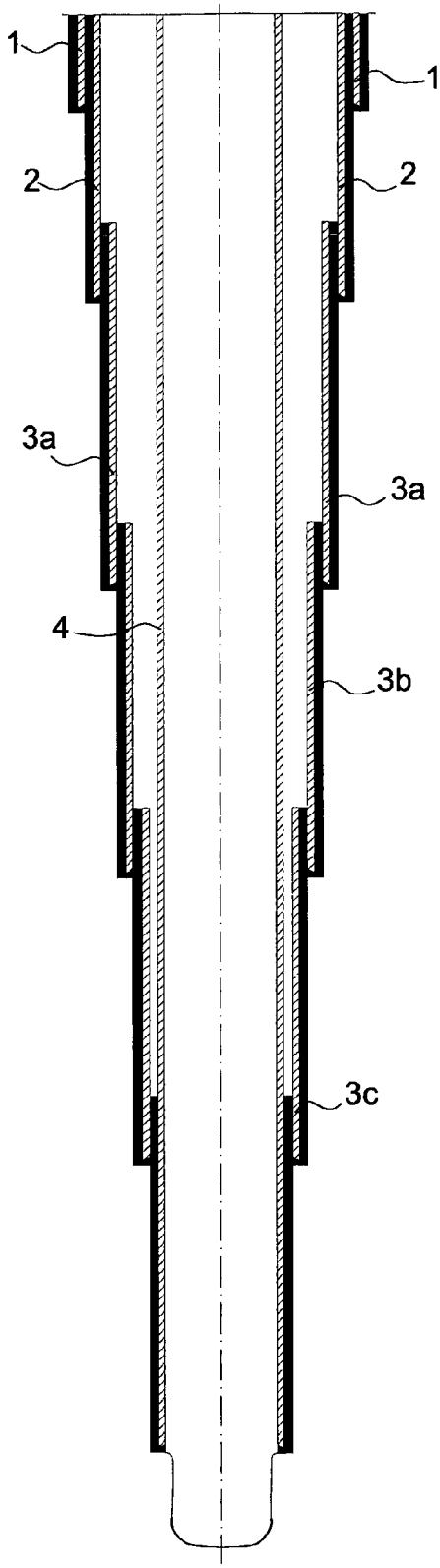
Fig. 1b PRIOR ART
Figure 2:
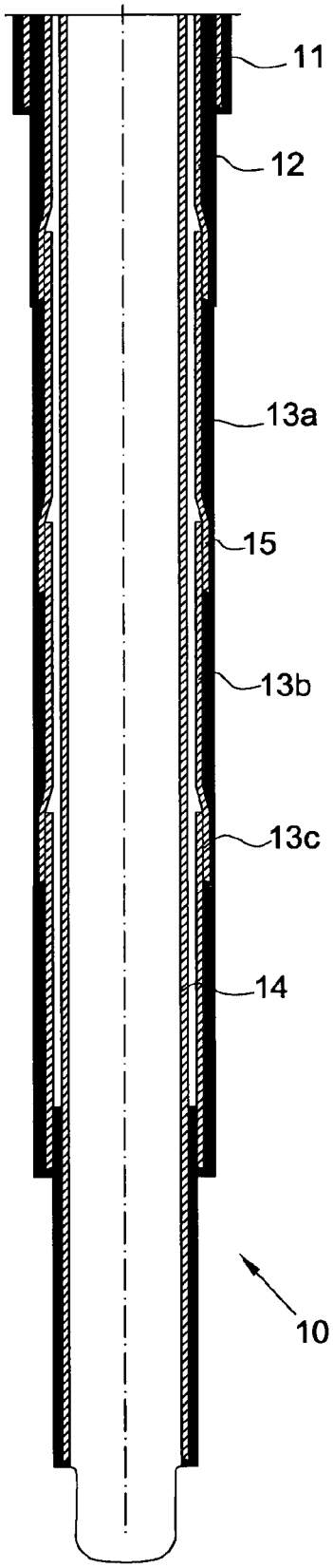
FIG. 2 is a schematic representation of the wells obtained by means of the anchoring and expanding unit, and the drilling method, according to the present invention.

With reference to FIG. 2, this shows the well 10 obtained by means of the drilling method according to the present invention.

This well 10 comprises a conductor pipe in the upper part, which reaches the surface and in which a surface column 12 is inserted, which also reaches the surface.

The conductor pipe 11 and the surface column 12 can be chosen with a reduced diameter. In the embodiment shown, the guide pipe 11 has a diameter of 339.7 mm and the surface column has a diameter of 244.5 mm.

The surface column 12 has, in its lower part, a bell 15, i.e. a portion having a larger diameter with respect to the diameter of the prevailing development of column 12, equal, for example, to 273.1 mm.

Connected to the bell 15 of the surface column 12, there is at least one intermediate column 13*a*, 13*b*, of the expandable type, enlarged so that it also forms, in its lower portion, a bell 15.

The enlargement diameters are selected so as to avoid an overall reduction of the hole diameter. Consequently, the upper portion of an intermediate column 13*a*, 13*c* is enlarged to a diameter corresponding to the inner diameter of the bell 15 of the previous column 12, 13*a*, 13*b*, whereas the lower portion 15 has a diameter similar to the external diameter of said bell 15, of the preceding column 12, 13*a*, 13*b*.

In the embodiment shown, the upper portion of the intermediate column is enlarged to a diameter of 244.5 mm, whereas the lower part is expanded to a diameter of 273.1 mm.

The maximum expansion, characteristic of the bell portion 15, is advantageously effected only in a limited tract of the intermediate column 13*a*-13*c* sufficient for the overlapping with the subsequent column.

Even if the lower portions of the intermediate columns are subject to less mechanical stress, and are, in any case, reinforced through the overlapping with the subsequent column, it is preferable to produce this portion with the minimum necessary dimensions.

If the drilling method of a well according to the invention is applied only to some tracts of said well, parts of the intermediate columns 13*a*-13*c* can also be selected non-expandable, but comprising a lower portion with a larger diameter.

In this case, the two expansion phases with a different diameter, will refer only to the expandable intermediate columns.

Finally, a production column 14, selected with a non-expandable material, is advantageously included to guarantee the characteristics of robustness of a traditional well, which columns made of expandable material 13*a*-13*c* are not capable of offering.

The production method of a well described can also be implemented with alternative embodiments of the anchoring and expanding unit 30,20, according to the present invention.

In a second embodiment illustrated in FIGS. 17-29, the anchoring and expanding unit comprises an anchoring device 20' of the traditional type and an expanding device 30' equipped with suspension means 24' to a previous intermediate column 12, 13*a*, 13*b*.

The expanding device 30', in addition to the elements described with respect to the first embodiment, comprises, in the upper part, hydraulic suspension means 24' forming a parallelogram.

These suspension means 24' comprise a series of parallelograms 62 assembled on a cylindrical body 63, driven in expansion by hydraulic pistons 64 and drawn by elastic means 65, such as, for example, a spring.

The suspension means 24' with a parallelogram 62, are capable of expanding the traditional anchoring device 20', thus fixing it to the previous column 13*a* by compression.

As shown in the sequence of figures from 18 to 29, the operative phases of the method according to the present invention differ only in their succession.

In particular, the release of the expanding device 30' from the anchoring device 20' occurs before the anchoring phase of the anchoring device 20' to the previous column 12, 13*a*, 13*b* (FIGS. 21 and 22).

More specifically, after releasing the expander 30' with a pressure of about 8.3 MPa (1,200 psi) for example, the pressure is increased to about 10.3 MPa (1,500 psi) for example, to break the stop pins 56' which are blocking the thrust ring 61 of the parallelograms 62.

The load is discharged, still maintaining the battery under pressure, so that the series of enlarged parallelograms 62 can expand the upper part of the anchoring device 20' thus anchoring the third external slips 23 against the preceding column 13*b*.

The expansion of the anchoring device 20' through the series of parallelograms 62 does not prevent the fluid circulation, in this way it can follow the cementation of the subsequent expandable column 13*b* with the same procedures already illustrated.

The parallelogram suspension means 24' are subsequently withdrawn in order to proceed with the expansion phases by means of the rolled pads 35. This is followed by the complete expansion of the anchoring device 20' and intermediate column 13*a*-13*c* constrained to it.

The characteristics of the device and method, object of the present invention, in addition to the relevant advantages, appear clear from the above description.

The presence of suspension means 24,24*a*,24' and specific slips 23 allow the expansion of the intermediate column to be effected while the expander is rotating, thus reducing damage on the inner part of the columns.

Furthermore, the specific conformation of the hydraulic actuation means acting on the expanders of the relative device, allow a much higher excursion with respect to traditional radial-run pistons, thus allowing a higher expansion thrust to be exerted, also during the forced expansion phase.

Again, thanks to the anchoring and expanding unit according to the present invention, during the drilling of a well, it is possible to effect the two expansion phases of a column, one after another and therefore before the gripping material solidifies.

In addition, the effecting of the strong expansion only on the lower portions of the intermediate columns together with the inclusion of a production column for covering said intermediate columns, make the overall stability characteristics of the well comparable to those of a traditional well in which only non-expandable and therefore stronger columns are used.

Finally, it is evident that the device thus conceived can undergo numerous modifications and variations, all included in the invention; furthermore, all the details can be substituted by technically equivalent elements. In practice, the materials used, as also the dimensions, can vary according to technical requirements.

The invention claimed is:

1. An anchoring and expanding unit, comprising:

an anchoring device and an expanding device, which are reciprocally and removably constrained, wherein the anchoring device is expandable;

the expanding device comprises a series of expanding elements, each of the expanding elements is stoppable in at least two different operative positions each of which is radially extracted with respect to the expanding device, the at least two different operative positions are each radially extracted from an initial position of the expanding elements, each of the expanding elements is stopped in a first of the at least two different operative positions by a stopping device, and when the stopping device is sheared, each of the expanding elements is movable to a second of the at least two different operative positions;

the expanding elements protrude radially from the expanding device; and the anchoring and expanding unit is suitable for drilling a well.

2. The anchoring and expanding unit according to claim 1, wherein the expanding elements comprise a pair of off-line rolls.

3. The anchoring and expanding unit according to claim 2, wherein the pair of off-line rolls comprises a first cylindrical roll and a second conical roll.

4. The anchoring and expanding unit according to claim 2, wherein the pair of off-line rolls is housed on a pad that is slidable along a pair of tilted guides, and at least a first guide of the pair of tilted guides is translatable towards a second guide of the pair of tilted guides.

5. The anchoring and expanding unit according to claim 4, further comprising a hydraulic actuation device that is configured to translate the first guide in a main development direction of the expanding device.

6. The anchoring and expanding unit according to claim 5, wherein the hydraulic actuation device comprises a wedge-shaped body connected to a rod supported by an annular body equipped with a narrowing ring, and the first guide is on a tilted wall of the wedge-shaped body.

7. The anchoring and expanding unit according to claim 5, wherein the expanding device is equipped with a first removable stopping device, to stop a run of the hydraulic actuation device in a first position corresponding to a first of the at least two different operative positions of the expanding elements.

8. The anchoring and expanding unit according to claim 1, wherein the expanding device is equipped with a hydraulic fixing device, to removably constrain the expanding device to the anchoring device.

9. The anchoring and expanding unit according to claim 8, wherein the hydraulic fixing device is a series of radially movable dogs, kept in a protruding position with respect to the expanding device by a first sleeve that is translatable along a main development direction of the expanding device to prevent the dogs from withdrawing.

10. The anchoring and expanding unit according to claim 9, wherein the dogs are engaged with corresponding recesses situated in the anchoring device.

11. The anchoring and expanding unit according to claim 1, further comprising a suspension element to constrain the anchoring device to the well.

12. The anchoring and expanding unit according to claim 11, wherein the suspension element has a radial expansion.

13. The anchoring and expanding unit according to claim 11, wherein the suspension element is on the anchoring device.

14. The anchoring and expanding unit according to claim 13, wherein the suspension element comprises a series of leaf springs actuatable by a hydraulic piston, thereby arching the leaf springs.

15. The anchoring and expanding unit according to claim 14, wherein the leaf springs comprise a series of first protuberances on a radially most external surface.

16. The anchoring and expanding unit according to claim 11, wherein the suspension element is on the expanding device.

17. The anchoring and expanding unit according to claim 16, wherein the suspension element comprises a series of parallelograms on a cylindrical body, and the unit further comprises hydraulic pistons configured to drive the parallelograms in expansion and an elastic device configured to bring the parallelograms back.

18. A method for drilling a well, the method comprising:

running and installing a conductor pipe, a surface column, and an intermediate column, thereby widening the intermediate column downwards to a first diameter;

lowering the intermediate column with the anchoring and expanding unit of claim 1;

positioning the anchoring and expanding unit in correspondence with the base of a last column previously installed;

raising the expanding device for a length substantially equal to an overlapping tract between two subsequent columns; and widening a lower tract of the intermediate column downwards to a second greater diameter with respect to the first diameter.

19. The method of claim 18, further comprising fixing the anchoring device of the anchoring and expanding unit to the base of the last column previously installed.

20. The method for drilling a well according to claim 19, further comprising permanently connecting the last column previously installed and the intermediate column to be installed through an expansion of the anchoring device.

21. The method for drilling a well according to claim 18, further comprising, before the widening to a first diameter and widening to a second greater diameter, cementing the intermediate column to be installed by the introduction of a gripping material, whereby the widening to a first diameter and widening to a second greater diameter are before the gripping material solidifies.

22. The method of claim 18, wherein the surface column comprises a lower bell portion configured to house the anchoring and expanding unit.

* * * * *